US006674863B2

(12) United States Patent
Ura

(10) Patent No.: US 6,674,863 B2
(45) Date of Patent: Jan. 6, 2004

(54) MICROPHONE-SPEAKER APPARATUS

(75) Inventor: Takefumi Ura, Kanagawa-ken (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/378,442

(22) Filed: Mar. 3, 2003

(65) Prior Publication Data

US 2003/0169892 A1 Sep. 11, 2003

(30) Foreign Application Priority Data

Mar. 5, 2002 (JP) ..... 2002-058891

(51) Int. Cl.[7] ..... H04R 15/00; H04R 27/00

(52) U.S. Cl. ..... 381/93; 381/83

(58) Field of Search ..... 381/93, 83, 66, 381/318, 94.2, 94.3; 379/406.01, 406.02, 406.05, 406.12, 106.13, 406.14, 406.15

(56) References Cited

U.S. PATENT DOCUMENTS

| | | | | |
|---|---|---|---|---|
| 5,644,641 A | * | 7/1997 | Ikeda | 381/94.1 |
| 5,677,987 A | | 10/1997 | Seki et al. | 381/83 |
| 5,910,994 A | | 6/1999 | Choe et al. | 381/93 |
| 5,999,631 A | | 12/1999 | Porayath et al. | 381/93 |
| 6,125,187 A | * | 9/2000 | Hanajima et al. | 381/83 |
| 6,128,392 A | | 10/2000 | Delf et al. | 381/93 |
| 6,252,969 B1 | * | 6/2001 | Ando | 381/103 |
| 6,442,280 B1 | * | 8/2002 | Ito | 381/83 |
| 2002/0126855 A1 | * | 9/2002 | Terada et al. | 381/93 |

OTHER PUBLICATIONS

Helgren J. et al: "Bias of feedback cancellation algorithms based on direct closed loop identification" 2000 IEEE International Conference on Acoustics, Speech, and Signal Processing. Proceedings. (ICASSP). Istanbul, Turkey, vol. 2, Jun. 5, 2000, pp. 869–872, XP010504861.

* cited by examiner

*Primary Examiner*—Xu Mei
(74) *Attorney, Agent, or Firm*—Pearne & Gordon LLP

(57) ABSTRACT

Herein disclosed is a microphone-speaker apparatus, comprising: audio signal dividing means for dividing the audio signal into a plurality of raw component signals each indicative of the raw wave components; coherent component signal extracting means for extracting a plurality of coherent component signals respectively indicative of the coherent wave components from the raw component signals divided by the audio signal dividing means; power value calculating means for calculating the raw power value of each of the coherent component signals extracted by the coherent component signal extracting means; power value adjusting means for adjusting the raw power value of each of the coherent component signals calculated by the power value calculating means to produce an adjusted power value of each of the coherent component signals; power value judging means for judging whether or not the adjusted power value of each of the coherent component signals of the current frame exceeds the adjusted power value of each of the coherent component signals of the preceding frame; power value ratio calculating means for calculating a power value ratio of the adjusted power value of each of the coherent component signals to an average value of the adjusted power values of the coherent component signals adjusted by the power value adjusting means; power value ratio judging means for judging whether or not the power value ratio of the adjusted power value of each of the coherent component signals to the average value of the adjusted power values of the coherent component signals calculated by the power value ratio calculating means exceeds a predetermined threshold value; howling sound judging means for judging whether or not the howling sound is produced while the microphone unit is receiving the audio sound outputted by the speaker unit during periodic intervals based on results judged by the power value judging means and results judged by the power value ratio judging means.

31 Claims, 14 Drawing Sheets

MICROPHONE-SPEAKER APPARATUS

BACKGROUND OF THE INVENTION

1. Field of the Invention

The present invention relates to a microphone-speaker apparatus, and more particularly to a microphone-speaker apparatus comprising howling sound judging means for judging whether or not a howling sound is produced while a microphone unit is receiving an audio sound outputted by a speaker unit without being affected by an amplitude of the audio sound received by the microphone unit.

2. Description of the Related Art

Up until now, there have been provided a wide variety of microphone-speaker apparatus of this type one typical example of which is shown in FIG. 14. The conventional microphone-speaker apparatus of this type is disclosed in pages 112–115 of the preprinted version of the Tokyo convention '95 of the Audio Engineering Society, titled "Automatic Finding and Eliminating Feedback System with DSP".

The conventional microphone-speaker apparatus 20 is shown in FIG. 14 as comprising a microphone unit 40 for receiving an audio sound represented by a raw sound wave varied in response to a time axis to convert the audio sound to an audio signal, the audio sound being constituted by a plurality of sub-band audio sounds each having an amplitude, the sub-band audio sounds respectively having frequency ranges divided along a frequency axis; audio signal dividing means 50 for dividing the audio signal received from the microphone unit 40 through an input terminal 30 into a plurality of sub-band audio signals respectively indicative of the sub-band audio sounds, each of the sub-band audio signals having a plurality of sequential frames divided along the time axis, and the sequential frames each having a current frame and a preceding frame prior to the current frame; maximum value obtaining means 60 for obtaining the maximum value from among the amplitudes of the sub-band audio signals in each of the sequential frames; and howling sound judging means 70 for judging whether or not the howling sound is produced while the microphone unit 40 is receiving the audio sound outputted by the speaker unit 80.

The howling sound judging means 70 is operative to judge whether or not the howling sound is produced while the microphone unit 40 is receiving the audio sound outputted by the speaker unit 80 through steps of judging whether or not the maximum value of the amplitudes of the sub-band audio signals in each of the sequential frames exceeds a predetermined threshold value, judging whether or not the frequency range in which the maximum value of the amplitudes of the sub-band audio signals is obtained by the maximum value obtaining means 60 in the current frame is the same as the frequency range in which the maximum value of the amplitudes of the sub-band audio signals is obtained by the maximum value obtaining means 60 in the preceding frame under the condition that each of the maximum value of the amplitudes of the sub-band audio signals obtained by the maximum value obtaining means 60 in the current frame and the maximum value of the amplitudes of the sub-band audio signals obtained by the maximum value obtaining means 60 in the preceding frame exceeds a predetermined threshold value, counting a number of the sequential frame in which the judgment is made that the frequency range in which the maximum value of the amplitudes of the sub-band audio signals is obtained by the maximum value obtaining means 60 in the current frame is the same as the frequency range in which the maximum value of the amplitudes of the sub-band audio signals is obtained by the maximum value obtaining means 60 in the preceding frame under the condition that each of the maximum value of the amplitudes of the sub-band audio signals obtained by the maximum value obtaining means 60 in the current frame and the maximum value of the amplitudes of the sub-band audio signals obtained by the maximum value obtaining means 60 in the preceding frame exceeds a predetermined threshold value, judging whether or not the number of the sequential frame counted in the third step exceeds a predetermined number.

The conventional microphone-speaker apparatus, however, encounters such a problem that the judgment tends to be mistakenly made by the howling sound judging means 70 that the howling sound is produced while the microphone unit 40 is receiving the audio sound outputted by the speaker unit 80 with being remarkably affected by the amplitude of the audio sound received by the microphone unit under the condition that the microphone unit 40 is continuously receiving the audio sound represented by the raw sound wave having a relatively high amplitude at a relatively long interval.

When the microphone unit 40 is also receiving a background noise having a relatively high level, the judgment tends to be mistakenly made by the howling sound judging means 70 that the howling sound is produced while the microphone unit 40 is receiving the audio sound outputted by the speaker unit 80 under the condition that the microphone unit 40 is continuously receiving the audio sound represented by the raw sound wave having a relatively high amplitude during a relatively long interval.

SUMMARY OF THE INVENTION

It is, therefore, an object of the present invention to provide a microphone-speaker apparatus which can enhance the quality of the audio sound to be outputted by the speaker unit by judging whether or not the howling sound is produced while the microphone unit is receiving the audio sound outputted by the speaker unit without being affected by the amplitude of the audio sound received by the microphone unit.

According to the first aspect of the present invention, there is provided a microphone-speaker apparatus, comprising: a microphone unit for receiving an audio sound represented by a raw sound wave varied in response to a time axis to convert the audio sound to an audio signal, the raw sound wave including a coherent sound wave and an incoherent sound wave, the raw sound wave being constituted by a plurality of raw wave components each having an audio frequency, and the coherent sound wave being constituted by a plurality of coherent wave components each having the audio frequency; a speaker unit for outputting the audio sound to the microphone unit, the audio sound including a howling sound represented by the coherent sound wave, and the howling sound being produced while the microphone unit is receiving the audio sound outputted by the speaker unit; audio signal dividing means for dividing the audio signal converted by the microphone unit into a plurality of raw component signals each indicative of the raw wave components, each of the raw component signals having a plurality of sequential frames divided along the time axis, and the sequential frames each having a current frame and a previous frame prior to the current frame; coherent component signal extracting means for extracting a plurality of coherent component signals respectively indicative of the coherent wave components from the raw component signals divided by the audio signal dividing means, each of the coherent component signals in each of the sequential frames having a raw power value; power value calculating means for calculating the raw power value of each of the coherent component signals extracted by the coherent component signal extracting means; power value adjusting means for adjusting the raw power value of each of the coherent component signals calculated by the power value calculating means to produce an adjusted power value of each of the coherent component signals; power value judging means for judging whether or not the adjusted power value of each of the coherent component signals of the current frame adjusted by the power value adjusting means exceeds the adjusted power value of each of the coherent component signals of the previous frame adjusted by the power value adjusting means; power value ratio calculating means for calculating a power value ratio of the adjusted power value of each of the coherent component signals to an average value of the adjusted power values of the coherent component signals adjusted by the power value adjusting means; power value ratio judging means for judging whether or not the power value ratio of the adjusted power value of each of the coherent component signals to the average value of the adjusted power values of the coherent component signals calculated by the power value ratio calculating mean exceeds a predetermined threshold value; howling sound judging means for judging whether or not the howling sound is produced while the microphone unit is receiving the audio sound outputted by the speaker unit based on results judged by the power value judging means and results judged by the power value ratio judging means; and howling sound suppressing means for suppressing the howling sound based on results judged by the howling sound judging means.

The coherent component signal extracting means may include a previous frame obtaining unit for obtaining the raw component signals of the previous frame in response to the raw component signals of the current frame divided by the audio signal dividing means, a coherent component signal extracting unit for extracting the coherent component signals, a signal difference obtaining unit for obtaining a signal difference between the raw component signals divided by the audio signal dividing means and the coherent component signals extracted by the coherent component signal extracting unit, and a signal coefficient producing unit for producing a plurality of signal coefficients in response to both the raw component signals of the previous frame obtained by the previous frame obtaining unit and the signal difference between the raw component signals of the current frame and the coherent component signals of the current frame calculated by the signal difference obtaining unit. The coherent component signal extracting unit may be operative to extract the coherent component signals in response to both the raw component signals of the previous frame obtained by the previous frame obtaining unit and the signal coefficients produced by the signal coefficient producing unit.

The power value adjusting means may be operative to adjust the raw power value of each of the coherent component signals calculated by the power value calculating means to obtain an adjusted power value of each of the coherent component signals through steps of adding a first product "A" to a second product "B", the first product "A" being indicative of a predetermined coefficient value multiplied by the raw power value of each of the coherent component signals in the current frame calculated by the power value calculating means, and the second product "B" being indicative of the adjusted power value of each of the coherent component signals in the preceding frame adjusted by the power value adjusting means multiplied by a value obtained by subtracting the predetermined coefficient value from a numerical value "1".

The power value judging means may include a previous frame obtaining unit for obtaining the coherent component signals of the previous frame in response to the coherent component signals of the current frame adjusted by the power value adjusting means, a power value judging unit for judging whether or not the adjusted power value of the coherent component signals of the current frame adjusted by the power value adjusting means exceeds the adjusted power value of the coherent component signals of the previous frame obtained by the previous frame obtaining unit, and a first counter unit for counting a number of the sequential frame in which the judgment is made by the power value judging unit that the adjusted power value of the coherent component signals of the current frame adjusted by the power value adjusting means exceeds the adjusted power value of the coherent component signals of the previous frame obtained by the previous frame obtaining unit; the power value ratio judging means includes a power value ratio judging unit for judging whether or not the power value ratio of the adjusted power value of each of the coherent component signals to the average value of the adjusted power values of the coherent component signals calculated by the power value ratio calculating means exceeds the predetermined first threshold value, and a second counter unit for counting a number of the sequential frame in which the judgment is made by the power value ratio judging unit that the power value ratio of the adjusted power value of each of the coherent component signals to the mean value of the adjusted power values of the coherent component signals calculated by the power value ratio calculating means, and the howling sound judging means is operative to judge whether or not the howling sound is produced while the microphone unit is receiving the audio sound outputted by the speaker unit through steps of judging whether or not the number of the sequential frame counted by the first counter unit exceeds a predetermined second predetermined value, and judging whether or not the number of the sequential frame counted by the second counter unit exceeds a predetermined third predetermined value.

The microphone-speaker apparatus may further comprise raw component power calculating means for calculating the power value of each of the raw component signals divided by the audio signal dividing means; raw component power adjusting means for adjusting the power value of each of the raw component signals calculated by the raw component power calculating means to produce an adjusted power value of each of the raw component signals; and raw component power judging means for judging whether or not the power value of each of the raw component signals of the current frame exceeds the power value of each of the raw component signals of the preceding frame. The howling sound judging means may be operative to judge whether or not the howling sound is produced while the microphone unit is receiving the audio sound outputted by the speaker unit based on each of results judged by the power value judging means, results judged by the raw component power judging means, and results judged by the power value ratio judging means.

The raw component power judging means may include a previous frame obtaining unit for obtaining the raw component signals of the previous frame in response to the raw component signals of the current frame adjusted by the raw component power adjusting means, a power value judging unit for judging whether or not the adjusted power value of the raw component signals of the current frame adjusted by the raw component power adjusting means exceeds the adjusted power value of the raw component signals of the previous frame obtained by the previous frame obtaining unit, and a third counter unit for counting a number of the sequential frame in which the judgment is made by the power value judging unit that the adjusted power value of the raw component signals of the current frame adjusted by the power value adjusting means exceeds the adjusted power value of the raw component signals of the previous frame obtained by the previous frame obtaining unit. The howling sound judging means may be operative to judge whether or not the howling sound is produced while the microphone unit is receiving the audio sound outputted by the speaker unit during periodic intervals through steps of judging whether or not the number of the sequential frame counted by the first counter unit exceeds a predetermined second predetermined value, judging whether or not the number of the sequential frame counted by the second counter unit exceeds a predetermined third predetermined value, and judging whether or not the number of the sequential frame counted by the third counter unit exceeds a predetermined fourth predetermined value.

The microphone-speaker apparatus may further comprise component signal estimating means for estimating and producing an estimated component signals of the current frames in response to both the raw component signals of the sequential frames divided by the audio signal dividing means and the signal coefficients produced by the signal coefficient producing unit; raw component power calculating means for calculating the power value of each of the estimated component signals estimated by the component signal estimating means; raw component power adjusting means for adjusting the power value of each of the estimated component signals calculated by the raw component power calculating means to produce an adjusted power value of each of the estimated component signals; and raw component power judging means for judging whether or not the power value of each of the estimated component signals of the current frame adjusted by the raw component power adjusting means exceeds the power value of each of the estimated component signals of the preceding frame adjusted by the raw component power adjusting means. The howling sound judging means may be operative to judge whether or not the howling sound is produced while the microphone unit is receiving the audio sound outputted by the speaker unit based on each of results judged by the power value judging means, results judged by the raw component power judging means, and results judged by the power value ratio judging means.

The raw component power judging means may include a previous frame obtaining unit for obtaining the estimated component signals of the previous frame in response to the estimated component signals of the current frame adjusted by the raw component power adjusting means, a power value judging unit for judging whether or not the adjusted power value of the estimated component signals of the current frame adjusted by the raw component power adjusting means exceeds the adjusted power value of the estimated component signals of the previous frame obtained by the previous frame obtaining unit, and a third counter unit for counting a number of the sequential frame in which the judgment is made by the power value judging unit that the adjusted power value of the estimated component signals of the current frame adjusted by the power value adjusting means exceeds the adjusted power value of the estimated component signals of the previous frame obtained by the previous frame obtaining unit. The howling sound judging means may be operative to judge whether or not the howling sound is produced while the microphone unit is receiving the audio sound outputted by the speaker unit during periodic intervals through steps of judging whether or not the number of the sequential frame counted by the first counter unit exceeds a predetermined second predetermined value, judging whether or not the number of the sequential frame counted by the second counter unit exceeds a predetermined third predetermined value, and judging whether or not the number of the sequential frame counted by the third counter unit exceeds a predetermined fourth predetermined value.

The power value judging means may include maximum power value obtaining unit for obtaining a maximum power value from among the adjusted power values of the coherent component signals adjusted by the power value adjusting means; a previous frame obtaining unit for obtaining the maximum power value of the coherent component signals of the previous frame in response to the maximum power value of the coherent component signals of the current frame obtained by the maximum power value obtaining unit, a power value judging unit for judging whether or not the maximum power value of the coherent component signals of the current frame obtained by the maximum power value obtaining unit exceeds the maximum power value of the coherent component signals of the previous frame obtained by the previous frame obtaining unit, and a third counter unit for counting a number of the sequential frame in which the judgment is made by the power value judging unit that the maximum power value of the coherent component signals of the current frame obtained by the maximum power value obtaining unit exceeds the maximum power value of the coherent component signals of the previous frame obtained by the previous frame obtaining unit.

The power value judging means may includes minimum power value obtaining unit for obtaining a minimum power value from among the adjusted power values of the coherent component signals adjusted by the power value adjusting means; a previous frame obtaining unit for obtaining the minimum power value of the coherent component signals of the previous frame in response to the minimum power value of the coherent component signals of the current frame obtained by the minimum power value obtaining unit, a power value judging unit for judging whether or not the minimum power value of the coherent component signals of the current frame obtained by the minimum power value obtaining unit exceeds the minimum power value of the coherent component signals of the previous frame obtained by the previous frame obtaining unit, and a third counter unit for counting a number of the sequential frame in which the judgment is made by the power value judging unit that the minimum power value of the coherent component signals of the current frame obtained by the minimum power value obtaining unit exceeds the minimum power value of the coherent component signals of the previous frame obtained by the previous frame obtaining unit.

The raw component power judging means may include maximum power value obtaining unit for obtaining a maximum power value from among the adjusted power values of the raw component signals adjusted by the raw component power adjusting means; a previous frame obtaining unit for obtaining the maximum power value of the raw component signals of the previous frame in response to the maximum power value of the raw component signals of the current frame obtained by the maximum power value obtaining unit, a power value judging unit for judging whether or not the maximum power value of the raw component signals of the current frame obtained by the maximum power value obtaining unit exceeds the maximum power value of the raw component signals of the previous frame obtained by the previous frame obtaining unit, and a third counter unit for counting a number of the sequential frame in which the judgment is made by the power value judging unit that the maximum power value of the raw component signals of the current frame obtained by the maximum power value obtaining unit exceeds the maximum power value of the raw component signals of the previous frame obtained by the previous frame obtaining unit.

The raw component power judging means may include minimum power value obtaining unit for obtaining a minimum power value from among the adjusted power values of the raw component signals adjusted by the power value adjusting means; a previous frame obtaining unit for obtaining the minimum power value of the raw component signals of the previous frame in response to the minimum power value of the raw component signals of the current frame obtained by the minimum power value obtaining unit, a power value judging unit for judging whether or not the minimum power value of the raw component signals of the current frame obtained by the minimum power value obtaining unit exceeds the minimum power value of the raw component signals of the previous frame obtained by the previous frame obtaining unit, and a third counter unit for counting a number of the sequential frame in which the judgment is made by the power value judging unit that the minimum power value of the raw component signals of the current frame obtained by the minimum power value obtaining unit exceeds the minimum power value of the raw component signals of the previous frame obtained by the previous frame obtaining unit.

The raw component power judging means may include maximum power value obtaining unit for obtaining a maximum power value from among the adjusted power values of the estimated component signals adjusted by the power value adjusting means; a previous frame obtaining unit for obtaining the maximum power value of the estimated component signals of the previous frame in response to the maximum power value of the estimated component signals of the current frame obtained by the maximum power value obtaining unit, a power value judging unit for judging whether or not the maximum power value of the estimated component signals of the current frame obtained by the maximum power value obtaining unit exceeds the maximum power value of the estimated component signals of the previous frame obtained by the previous frame obtaining unit, and a third counter unit for counting a number of the sequential frame in which the judgment is made by the power value judging unit that the maximum power value of the estimated component signals of the current frame obtained by the maximum power value obtaining unit exceeds the maximum power value of the estimated component signals of the previous frame obtained by the previous frame obtaining unit.

The raw component power judging means may include minimum power value obtaining unit for obtaining a minimum power value from among the adjusted power values of the estimated component signals adjusted by the power value adjusting means; a previous frame obtaining unit for obtaining the minimum power value of the estimated component signals of the previous frame in response to the minimum power value of the raw estimated component signals of the current frame obtained by the minimum power value obtaining unit, a power value judging unit for judging whether or not the minimum power value of the estimated component signals of the current frame obtained by the minimum power value obtaining unit exceeds the minimum power value of the estimated component signals of the previous frame obtained by the previous frame obtaining unit, and a third counter unit for counting a number of the sequential frame in which the judgment is made by the power value judging unit that the minimum power value of the estimated component signals of the current frame obtained by the minimum power value obtaining unit exceeds the minimum power value of the estimated component signals of the previous frame obtained by the previous frame obtaining unit.

The power value calculating means may be operative to calculate each of the raw sub-band power values from the coherent component signals extracted by the coherent component signal extracting means. The power value adjusting means may be operative to respectively adjust the raw sub-band power values calculated by the power value calculating means to produce an adjusted sub-band power values. The power value judging means may be operative to judging whether or not the adjusted each of the adjusted sub-band power values of the current frame exceeds each of the adjusted sub-band power values of the previous frame in each of the frequency ranges. The power value ratio calculating means may be operative to calculate a power value ratio of each of the adjusted sub-band power values to an average value of the adjusted sub-band power values. The power value ratio judging means may be operative to judge whether or not the power value ratio of each of the adjusted sub-band power values to the average value of the adjusted sub-band power values exceeds a predetermined threshold value.

The raw component power calculating means may be operative to calculate each of the raw sub-band power values from the raw component signals divided by the audio signal dividing means. The raw component power adjusting means may be operative to respectively adjust the raw sub-band power values calculated by the raw component power calculating means to produce an adjusted sub-band power values. The raw component power judging means may be operative to judge whether or not the adjusted sub-band power values of the current frame exceeds the adjusted sub-band power value of the previous frame in each of the frequency ranges.

The raw component power calculating means may be operative to calculate each of the raw sub-band power values from the estimated component signals estimated by the component signal estimating means, the raw sound wave being constituted by a plurality of sub-band sound wave components each having a frequency range and a raw sub-band power value. The raw component power adjusting means may be operative to respectively adjust the sub-band power values calculated by the raw component power calculating means to produce adjusted sub-band power values. The raw component power judging means may be operative to judging whether or not the each of the sub-band power values of the current frame exceeds each of the sub-band power value of the previous frame in each of the frequency ranges.

According to the second aspect of the present invention, there is provided a microphone-speaker apparatus, comprising: a microphone unit for receiving an audio sound represented by a raw sound wave varied in response to a time axis to convert the audio sound to an audio signal, the raw sound wave including a coherent sound wave and an incoherent sound wave, the raw sound wave being constituted by a plurality of raw sub-band wave components each having a frequency range, and the coherent sound wave being constituted by a plurality of coherent wave components each having the audio frequency; a speaker unit for outputting the audio sound to the microphone unit, the audio sound including a howling sound represented by the coherent sound wave, and the howling sound being produced while the microphone unit is receiving the audio sound outputted by the speaker unit; audio signal dividing means for dividing the audio signal converted by the microphone unit into a plurality of raw sub-band component signals each indicative of the raw sub-band wave components, each of the raw sub-band component signals having a plurality of sequential frames divided along the time axis, and the sequential frames each having a current frame and a previous frame prior to the current frame; coherent component signal extracting means for extracting a plurality of sub-band coherent component signals respectively indicative of the coherent wave components from the raw sub-band component signals divided by the audio signal dividing means, and each of the sub-band coherent component signals in each of the sequential frames having a raw sub-band power value; power value calculating means for calculating the raw sub-band power value of each of the sub-band coherent component signals extracted by the sub-band coherent component signal extracting means; power value adjusting means for adjusting the raw sub-band power value of each of the sub-band coherent component signals calculated by the power value calculating means to produce an adjusted sub-band power value of each of the sub-band coherent component signals; power value judging means for judging whether or not the adjusted sub-band power value of each of the sub-band coherent component signals of the current frame adjusted by the power value adjusting means exceeds the adjusted sub-band power value of each of the sub-band coherent component signals of the previous frame adjusted by the power value adjusting means; power value ratio calculating means for calculating a power value ratio of the adjusted sub-band power value of each of the sub-band coherent component signals to an average value of the adjusted sub-band power values of the sub-band coherent component signals adjusted by the power value adjusting means; power value ratio judging means for judging whether or not the power value ratio of the adjusted sub-band power value of each of the sub-band coherent component signals to the average value of the adjusted sub-band power values of the sub-band coherent component signals calculated by the power value ratio calculating means exceeds a predetermined threshold value; howling sound judging means for judging whether or not the howling sound is produced while the microphone unit is receiving the audio sound outputted by the speaker unit based on results judged by the power value judging means and results judged by the power value ratio judging means; and howling sound suppressing means for suppressing the howling sound based on results judged by the howling sound judging means.

BRIEF DESCRIPTION OF THE DRAWINGS

The present invention and many of the attendant advantages thereof will be better understood from the following detailed description when considered in connection with the accompanying drawings, wherein.

DESCRIPTION OF THE PREFERRED EMBODIMENTS

The following description will be directed to preferred embodiments of the microphone-speaker apparatus according to the present invention with reference to FIGS. 1 to 13.

The first embodiments of the microphone-speaker apparatus 100 according to the present invention will now be described in detail hereinafter with reference to FIG. 1.

The construction of the microphone-speaker apparatus 100 according to the first embodiment of the present invention will firstly be described.

Figure 1:
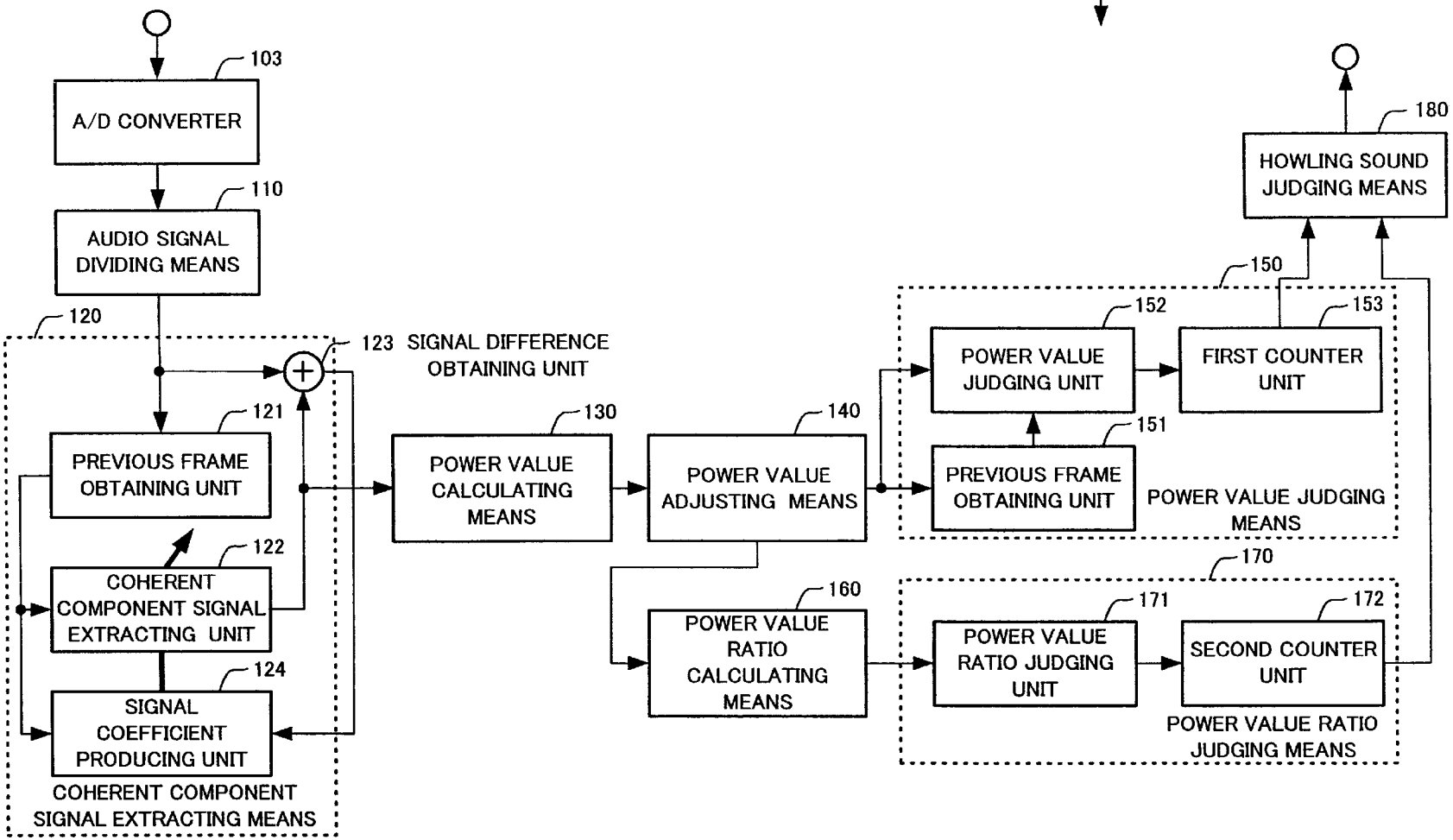
FIG. 1 is a block diagram of the microphone-speaker apparatus according to the first embodiment of the present invention.

Referring to FIG. 1 of the drawings, there is shown a microphone-speaker apparatus 100 comprising: a microphone unit 101 for receiving an audio sound represented by a raw sound wave varied in response to a time axis to convert the audio sound to an analog audio signal, the raw sound wave including a coherent sound wave and an incoherent sound wave, the coherent sound wave including a normal sound wave and an abnormal sound wave, the raw sound wave being constituted by a plurality of raw wave components each having an audio frequency, and the coherent sound wave being constituted by a plurality of coherent wave components each having the audio frequency; an analog to digital converter (simply referred to as "A/D converter") 103 for converting the analog audio signal converted by the microphone unit 101 into a digital audio signal (simply referred to as "audio signal"); a speaker unit 102 for outputting the audio sound to the microphone unit 101, the audio sound including a howling sound represented by the abnormal sound wave, and the howling sound being produced while the microphone unit 101 is receiving the audio sound outputted by the speaker unit 102; audio signal dividing means 110 for dividing the audio signal received from the microphone unit 101 through the A/D converter 103 into a plurality of raw component signals each indicative of the raw wave components based on frequency components analyzing methods such as for example a Fast Fourier Transformation, each of the raw component signals having a plurality of sequential frames divided along the time axis, and the sequential frames each having a current frame and a previous frame prior to the current frame; coherent component signal extracting means 120 for extracting a plurality of coherent component signals respectively indicative of the coherent wave components in response to the raw component signals divided by the audio signal dividing means 110 in each of the sequential frames, and each of the coherent component signals in each of the sequential frames having a raw power value; power value calculating means 130 for calculating the raw power value of each of the coherent component signals extracted by the coherent component signal extracting means 120 in each of the sequential frame; power value adjusting means 140 for adjusting the raw power value of each of the coherent component signals calculated by the power value calculating means 130 to produce an adjusted power value of each of the coherent component signals in each of the sequential frame; power value judging means 150 for judging whether or not the adjusted power value of each of the coherent component signals in the current frame adjusted by the power value adjusting means 140 is increased along the time axis in each of the frequencies; power value ratio calculating means 160 for calculating a power value ratio of the adjusted power value of each of the coherent component signals to an average value of the adjusted power values of the coherent component signals adjusted by the power value adjusting means 140 in each of the sequential frames; power value ratio judging means 170 for judging whether or not the power value ratio of the adjusted power value of each of the coherent component signals to the average value of the adjusted power values of the coherent component signals calculated by the power value ratio calculating means 160 exceeds a predetermined threshold value in each of the sequential frames; howling sound judging means 180 for judging whether or not the howling sound is produced while the microphone unit 101 is receiving the audio sound outputted by the speaker unit 102 based on each of results judged by the power value judging means 150 and results judged by the power value ratio judging means 170.

Figure 11:
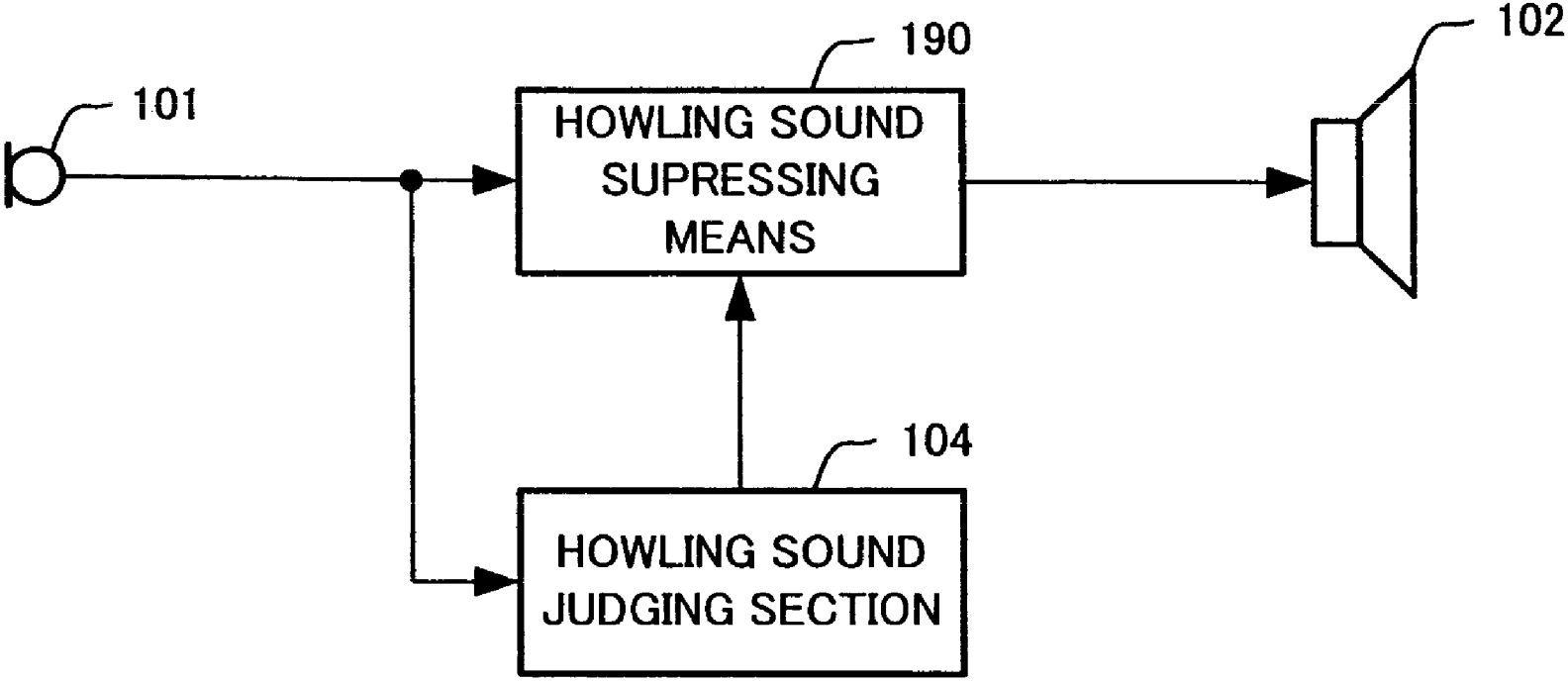
FIG. 11 is a block diagram of the microphone-speaker apparatus according to the first to sixth embodiments of the present invention.

The audio signal dividing means 110, the coherent component signal extracting means 120, the power value calculating means 130, the power value adjusting means 140, the power value judging means 150, the power value ratio calculating means 160, and the power value ratio judging means 170, as shown in FIG. 11, collectively constitutes a howling sound judging section 104.

The term "coherent component wave" herein described is intended to indicate a sine wave.

The coherent component signal extracting means 120 includes a previous frame obtaining unit 121 for obtaining the raw component signals of the previous frame in response to the raw component signals of the current frame divided by the audio signal dividing means 110 in each of the sequential frames, a coherent component signal extracting unit 122 for extracting the coherent component signals in each of the sequential frames, a signal difference obtaining unit 123 for obtaining a signal difference between the raw component signals divided by the audio signal dividing means 110 and the coherent component signals extracted by the coherent component signal extracting unit 122 in each of the sequential frames, and a signal coefficient producing unit 124 for producing a plurality of signal coefficients in response to both the raw component signals of the previous frame obtained by the previous frame obtaining unit 121 and the signal difference between the raw component signals of the current frame and the coherent component signals of the current frame calculated by the signal difference obtaining unit 123; and the coherent component signal extracting unit 122 is operative to extract the coherent component signals in each of the sequential frames in response to both the raw component signals of the previous frame obtained by the previous frame obtaining unit 121 and the signal coefficients produced by the signal coefficient producing unit 124. The previous frame obtaining unit 121, the coherent component signal extracting unit 122, and the signal difference obtaining unit 123 are respectively constituted by a delay device, an adaptive filter, and a subtracter.

In the microphone-speaker apparatus 100 according to the first embodiment of the present invention thus constructed as previously mentioned, the component signals divided by the audio signal dividing means 110 are adaptively filtered by the coherent component signal extracting unit 122 with reference to the component signals delayed by the previous frame obtaining unit 121 having a predetermined delay time which is previously adjusted by an operator.

The component signals forming part of the component signals divided by the audio signal dividing means 110 hardly correlates with the coherent component of the component signals delayed by the previous frame obtaining unit 121 under the condition that the component signals are respectively delayed by the previous frame obtaining unit 121 in response to the predetermined delay time, however, the coherent components of the component signals divided by the audio signal dividing means 110, such as the howling sound, securely correlate with the coherent component of the component signals delayed by the previous frame obtaining unit 121. The component signals delayed by the previous frame obtaining unit 121 in response to the thus adjusted delay time are respectively inputted to the coherent component signal extracting unit 122 as a reference signals.

The component signals delayed by the previous frame obtaining unit 121 are adaptively filtered by the coherent component signal extracting unit 122 through a step of multiplying the component signals by the signal coefficients while the signal coefficient producing unit 124 is receiving a minimum value of the mean squared error of the signal difference between the component signals divided by the audio signal dividing means 110 and the component signals filtered by the coherent component signal extracting unit 122. Here, the inclined arrow of the coherent component signal extracting unit 122 shown in FIG. 1 indicates the fact that the filter coefficients are respectively updated by the signal coefficient producing unit 124 during periodic intervals. This leads to the fact the coherent components can be extracted by the coherent component signal extracting unit 122 from the component signals by using the filter coefficients updated by the filter coefficient producing unit 124 during periodic intervals.

The following description will now be directed to the algorithm to be performed by the signal coefficient producing unit 124.

The signal coefficient producing unit 124 is operative to produce and update the signal coefficients in each of the sequential frames in response to both the raw component signals of the previous frame obtained by the previous frame obtaining unit 121 and the signal difference between the raw component signals of the current frame and the coherent component signals of the current frame calculated by the signal difference obtaining unit 123 based on the complex least mean square algorithm depending on a following equation (1).

$$W(k+1) = W(k) + \alpha \frac{E(k)}{\delta + X(k)^T X(k)^*} X(k)^* \quad (1)$$

Where, the legends "X(k)", "E(k)", and "W(k)" respectively represent the component signals, the difference signal, and the signal coefficients. The legends "k", "α", and "δ" further respectively represent a sequential number indicative of each of the sequential frame, a predetermined first value, and a predetermined second value. The legends $X(k)^T$ and $X(k)^*$ still further respectively represent a transposition of the component signals "X(k)" and a conjugation of the component signals "X(k)".

Although the complex normalized least mean square algorithm is performed by the signal coefficient producing unit 124 based on the equation (1), any one of the algorithms such as for example a complex least mean square algorithm, a recursive complex least squares algorithm, and a complex fast recursive least squares algorithm may be performed by the signal coefficient producing unit 124. The minimum value of the mean square of the signal difference is obtained by the signal coefficient producing unit 124 through step of updating the signal coefficients to be received by the coherent component signal extracting unit 122 based on the equation (1).

The power value adjusting means 140 is operative to adjust the raw power value of each of the coherent component signals calculated by the power value calculating means 130 in each of the sequential frames to obtain an adjusted power value "P(k)" of each of the coherent component signals through steps of adding a first product "FF×P_pre(k)" to a second product "(1.0−FF)×P(k−1)", the first product "FF×P_pre(k)" being indicative of a predetermined coefficient value "FF" multiplied by the raw power value "P_pre(k)" of each of the coherent component signals in the current frame "k" calculated by the power value calculating means 130, and the second product "FF×P_pre(k)" being indicative of the adjusted power value "P(k−1)" of each of the coherent component signals in the preceding frame "k−1" adjusted by the power value adjusting means 140 multiplied by a value "1.0−FF" obtained by subtracting the predetermined coefficient "FF" value from a numerical value "1.0".

$$P(k)=FF\times P_pre(k)+(1.0-FF)\times P(k-1) \quad (2)$$

The power value judging means 150 includes a previous frame obtaining unit 151 for obtaining the coherent component signals of the previous frame in response to the coherent component signals of the current frame adjusted by the power value adjusting means 140 in each of the sequential frames, a power value judging unit 152 for judging whether or not the adjusted power value of the coherent component signals of the current frame adjusted by the power value adjusting means 140 exceeds the adjusted power value of the coherent component signals of the previous frame obtained by the previous frame obtaining unit 151, and a first counter unit 153 having a value and operative to allow the value to be incremented by a numeral "1" when the judgment is made by a power value judging unit 152 that the adjusted power value of the coherent component signals of the current frame adjusted by the power value adjusting means 140 exceeds the adjusted power value of the coherent component signals of the previous frame obtained by the previous frame obtaining unit 151; the power value ratio judging means 170 includes a power value ratio judging unit 171 for judging whether or not the power value ratio of the adjusted power value of each of the coherent component signals to the average value of the adjusted power values of the coherent component signals calculated by the power value ratio calculating means 160 exceeds the predetermined first threshold value in each of the sequential frames, and a second counter unit 172 having a value and operative to allow the value to be incremented by a numeral "1" when the judgment is made by the power value ratio judging unit 171 that the power value ratio of the adjusted power value of each of the coherent component signals to the mean value of the adjusted power values of the coherent component signals calculated by the power value ratio calculating means 160 in each of the sequential frames, and the howling sound judging means 180 is operative to judge whether or not the howling sound is produced while the microphone unit 101 is receiving the audio sound outputted by the speaker unit 102 through steps of judging whether or not the value counted by the first counter unit 153 exceeds a predetermined second predetermined value, and judging whether or not the value counted by the second counter unit 172 exceeds a predetermined third predetermined value.

Figure 12:
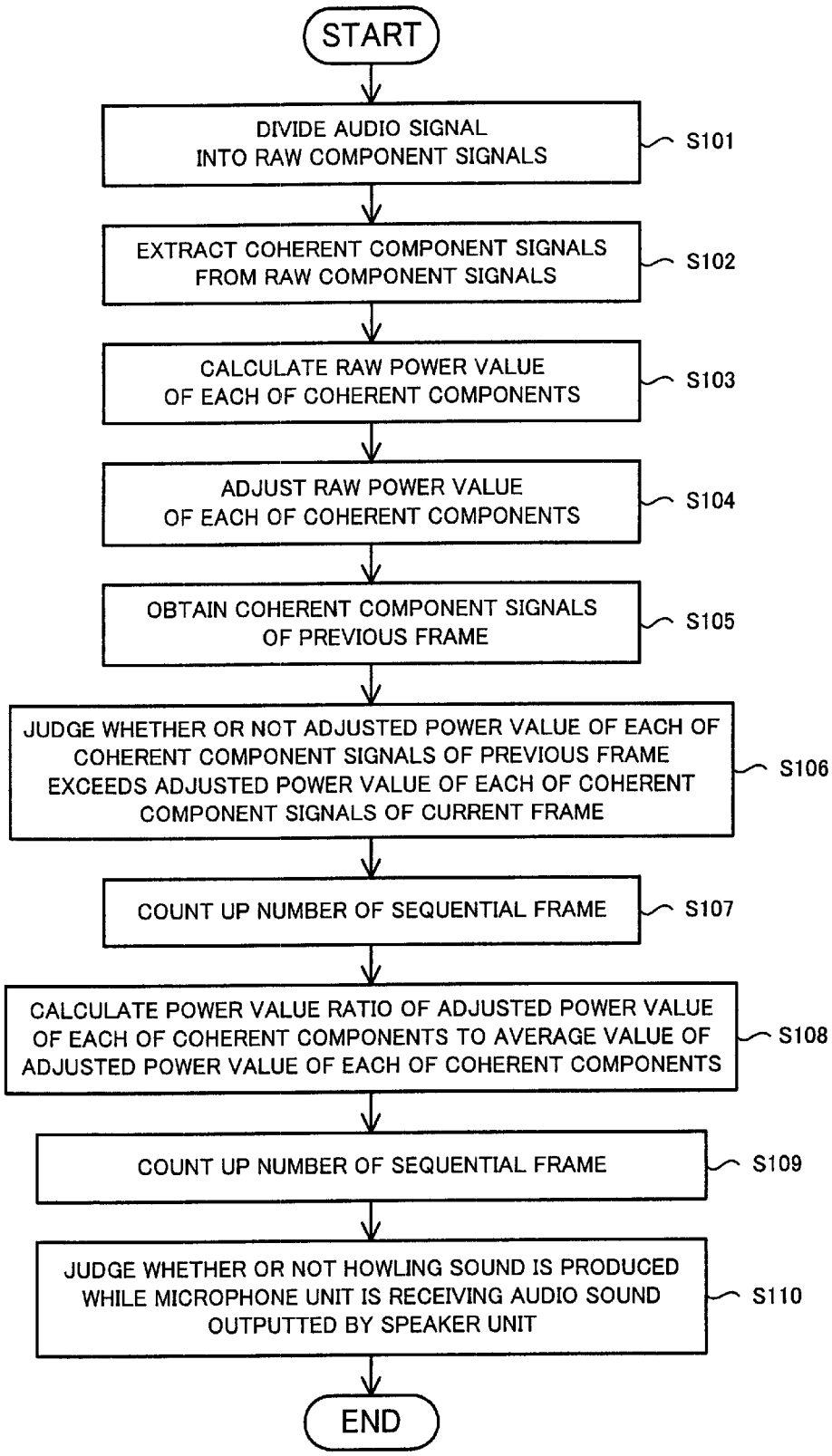
FIG. 12 is a flowchart of the microphone-speaker apparatus according to the first embodiment of the present invention.

The following description will now be directed to the process of the first embodiment of the microphone-speaker apparatus 100 according to the present invention with reference to FIG. 12.

The audio sound is firstly received by the microphone unit 101 to convert the audio sound to an analog audio signal. The audio signal received from the microphone unit 101 through the A/D converter 103 is then divided by the audio signal dividing means 110 in the step S101.

The coherent component signals are respectively extracted by the coherent component signal extracting means 120 from the raw component signals divided by the audio signal dividing means 110 in each of the sequential frames in the step S102.

The raw power value of each of the coherent component signals extracted by the coherent component signal extracting means 120 is then calculated by the power value calculating means 130 in each of the sequential frames in the step S103.

The raw power value of each of the coherent component signals calculated by the power value calculating means 130 is then adjusted by the power value adjusting means 140 to produce an adjusted power value of each of the coherent component signals in each of the sequential frame in the step S104.

The coherent component signals of the previous frame is then obtained by the previous frame obtaining unit 151 forming part of the power value judging means 150 in response to the coherent component signals of the current frame adjusted by the power value adjusting means 140 in each of the sequential frames in the step S105.

The judgment is then made by the power value judging unit 152 forming part of the power value judging means 150 whether or not the adjusted power value of the coherent component signals of the current frame adjusted by the power value adjusting means 140 exceeds the adjusted power value of the coherent component signals of the previous frame obtained by the previous frame obtaining unit 151 in each of the sequential frames in the step S106.

The first counter unit 153 is controlled by the power value judging unit 152 to allow the value to be incremented by a numeral "1" when the judgment is made by the power value judging unit 152 that the adjusted power value of the coherent component signals of the current frame exceeds the adjusted power value of the coherent component signals of the previous frame in the step S107. The first counter unit 153 is, on the other hand, controlled by the power value judging unit 152 to allow the value to be replaced by a numeral "0" when the judgment is made by the power value judging unit 152 that the adjusted power value of the coherent component signals of the current frame does not exceed the adjusted power value of the coherent component signals of the previous frame.

The power value ratio of the adjusted power value of each of the coherent component signals to an average value of the adjusted power values of the coherent component signals is then calculated by the power value ratio calculating means 160 in each of the sequential frames in the step S108.

The judgment is then made by the power value ratio judging unit 171 forming part of the power value ratio judging means 170 on whether or not the power value ratio of the adjusted power value of each of the coherent component signals to the average value of the adjusted power values of the coherent component signals calculated by the power value ratio calculating means 160 exceeds the predetermined first threshold value in each of the sequential frames in the step S109.

The number of the sequential frame in which the judgment is made that the power value ratio of the adjusted power value of each of the coherent component signals to the mean value of the adjusted power values of the coherent component signals is then counted by the second counter unit 172 forming part of the power value ratio judging means 170 in the step S110.

The judgment is then made by the howling sound judging means 180 on whether or not the howling sound is produced while the microphone unit 101 is receiving the audio sound outputted by the speaker unit 102 through steps of judging whether or not the value counted by the first counter unit 153 exceeds a predetermined second predetermined value, and judging whether or not the value counted by the second counter unit 172 exceeds a predetermined third predetermined value in the step S111.

The howling sound is finally suppressed by the howling sound suppressing means 190 based on results judged by the howling sound judging means 180.

From the above detailed description, it will be understood that the microphone-speaker apparatus according to the first embodiment of the present invention can enhance the quality of the audio sound to be outputted by the speaker unit by judging whether or not the howling sound is produced while the microphone unit is receiving the audio sound outputted by the speaker unit without being affected by the amplitude of the audio sound received by the microphone unit.

Figure 7:
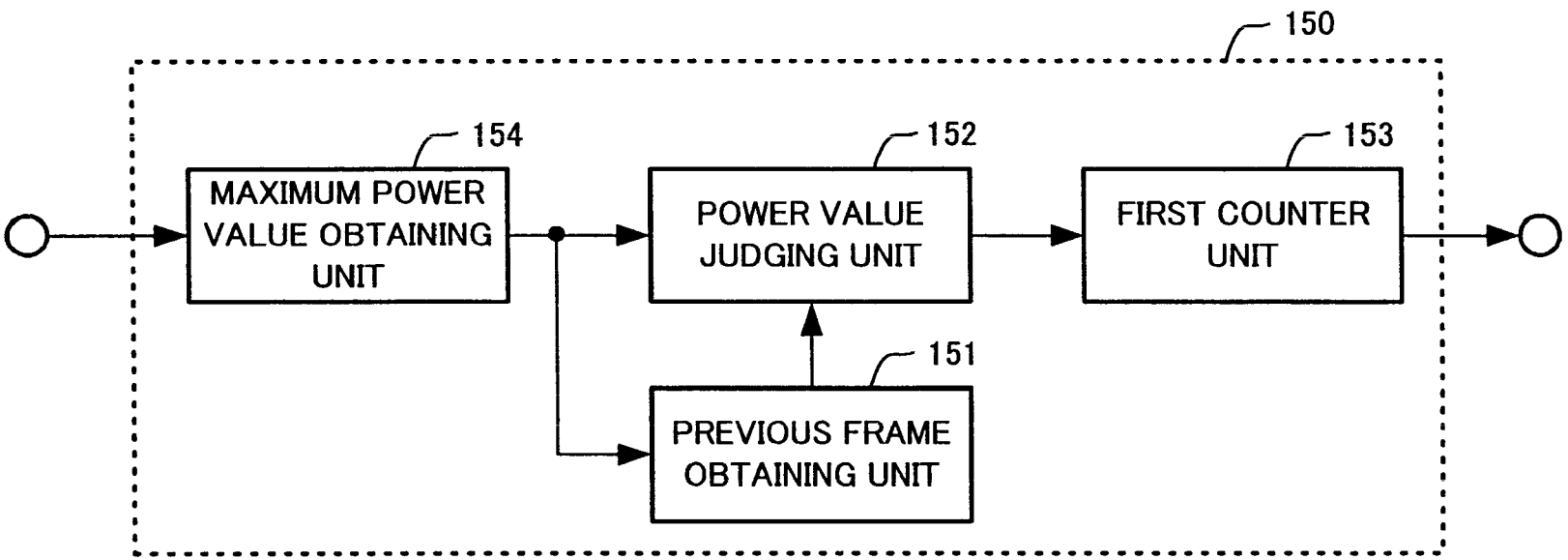
FIG. 7 is a block diagram of the power value judging means forming part of the microphone-speaker apparatus according to the first embodiment of the present invention.

While there has been described in the foregoing first embodiment about the fact that the power value judging means 150 includes a previous frame obtaining unit 151 for obtaining the coherent component signals of the previous frame in response to the coherent component signals of the current frame adjusted by the power value adjusting means 140, a power value judging unit 152 for judging whether or not the adjusted power value of the coherent component signals of the current frame adjusted by the power value adjusting means 140 exceeds the adjusted power value of the coherent component signals of the previous frame obtained by the previous frame obtaining unit 151, and a first counter unit 153 having a value and operative to allow the value to be incremented by a numeral "1" when the judgment is made by the power value judging unit 152 that the adjusted power value of the coherent component signals of the current frame adjusted by the power value adjusting means 140 exceeds the adjusted power value of the coherent component signals of the previous frame obtained by the previous frame obtaining unit 151, the power value judging means 150, as shown in FIG. 7, may include a maximum power value obtaining unit 154 for obtaining a maximum power value from among the adjusted power values of the coherent component signals adjusted by the power value adjusting means 140; a previous frame obtaining unit 151 for obtaining the maximum power value of the coherent component signals of the previous frame in response to the maximum power value of the coherent component signals of the current frame obtained by the maximum power value obtaining unit 154, a power value judging unit 152 for judging whether or not the maximum power value of the coherent component signals of the current frame obtained by the maximum power value obtaining unit 154 exceeds the maximum power value of the coherent component signals of the previous frame obtained by the previous frame obtaining unit 151, and a first counter unit 153 having a value and operative to allow the value to be incremented by a numeral "1" when the judgment is made by the power value judging unit 152 that the maximum power value of the coherent component signals of the current frame obtained by the maximum power value obtaining unit 154 exceeds the maximum power value of the coherent component signals of the previous frame obtained by the previous frame obtaining unit 151.

Figure 8:
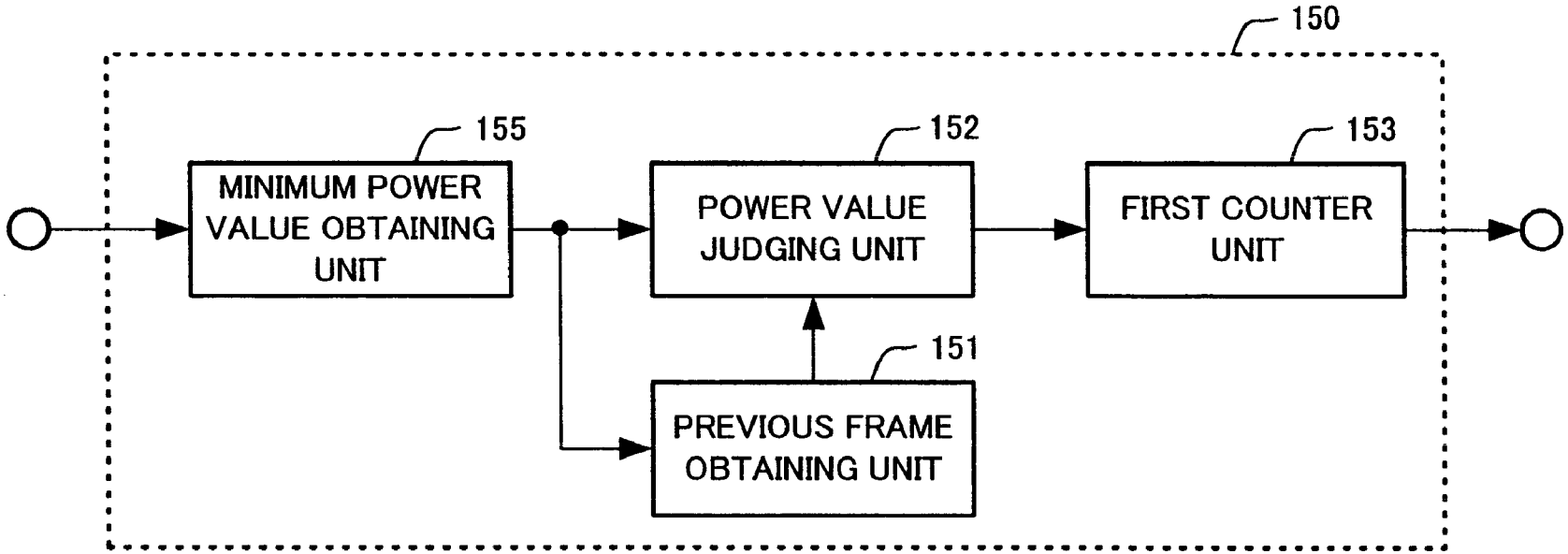
FIG. 8 is a block diagram of the power value judging means forming part of the microphone-speaker apparatus according to the first embodiment of the present invention.
Figure 9:
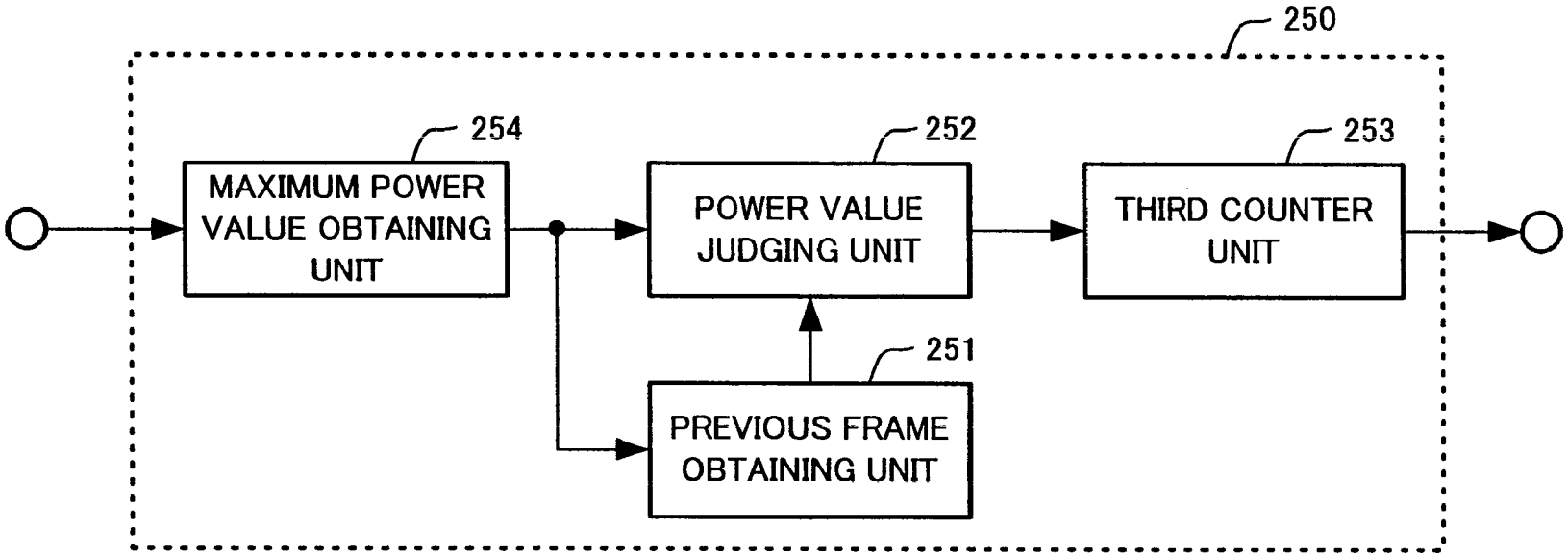
FIG. 9 is a block diagram of the power value judging means forming part of the microphone-speaker apparatus according to the first embodiment of the present invention.
Figure 10:
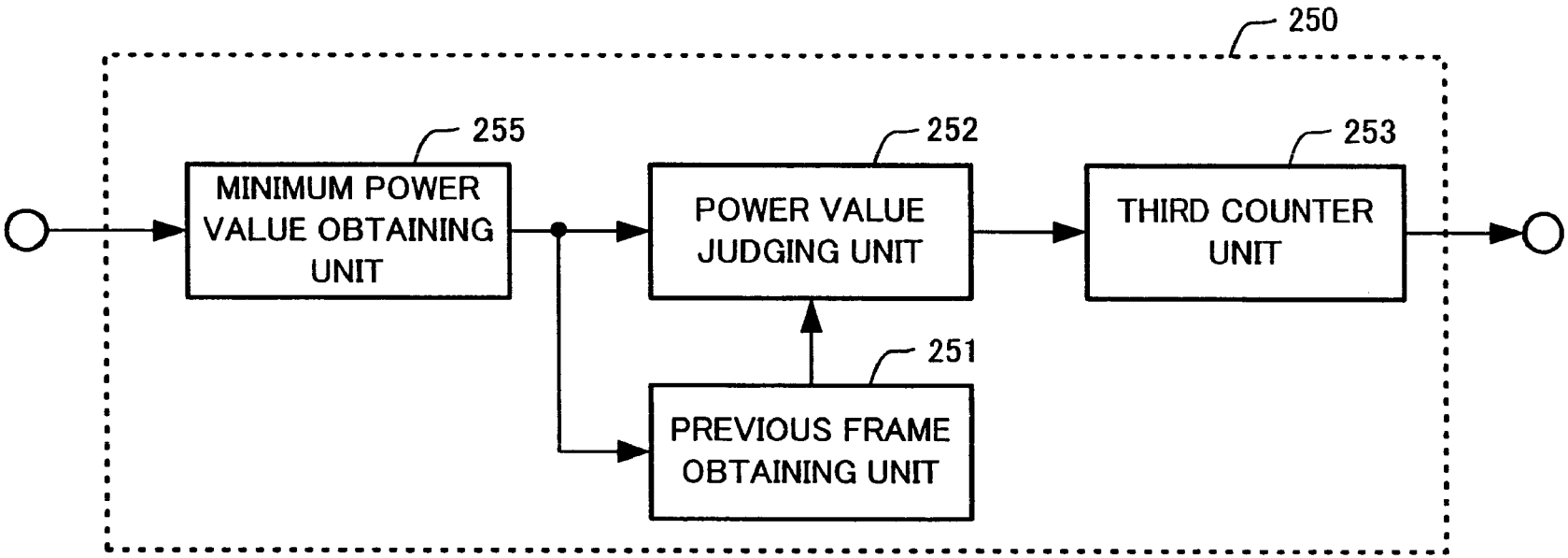
FIG. 10 is a block diagram of the power value judging means forming part of the microphone-speaker apparatus according to the first embodiment of the present invention.

On the other hand, the power value judging means 150, as shown in FIG. 8, may include a minimum power value obtaining unit 155 for obtaining a minimum power value from among the adjusted power values of the coherent component signals adjusted by the power value adjusting means 140; a previous frame obtaining unit 151 for obtaining the minimum power value of the coherent component signals of the previous frame in response to the minimum power value of the coherent component signals of the current frame obtained by the minimum power value obtaining unit 155, a power value judging unit 152 for judging whether or not the minimum power value of the coherent component signals of the current frame obtained by the minimum power value obtaining unit 155 exceeds the minimum power value of the coherent component signals of the previous frame obtained by the previous frame obtaining unit 151, and a first counter unit 153 having a value and operative to allow the value to be incremented by a numeral "1" when the judgment is made by the power value judging unit 152 that the minimum power value of the coherent component signals of the current frame obtained by the minimum power value obtaining unit 155 exceeds the minimum power value of the coherent component signals of the previous frame obtained by the previous frame obtaining unit 151.

The coherent sound wave is constituted by a plurality of sub-band coherent wave components each having a frequency range and a raw sub-band power value.

In the first embodiment, the power value calculating means 130 is operative to calculate the raw power value of each of the coherent component signals extracted by the coherent component signal extracting means 120 in each of the sequential frame, however, the power value calculating means 130, may be operative to calculate each of the raw sub-band power values from the coherent component signals extracted by the coherent component signal extracting means 120 in each of the frequency ranges, the power value adjusting means 140 being operative to respectively adjust the raw sub-band power values calculated by the power value calculating means 130 to produce an adjusted sub-band power values in each of the frequency ranges, the power value judging means 150 being operative to judging whether or not the adjusted each of the adjusted sub-band power values of the current frame exceeds each of the adjusted sub-band power values of the previous frame in each of the frequency ranges in each of the frequency ranges, the power value ratio calculating means 160 being operative to calculate a power value ratio of each of the adjusted sub-band power values to an average value of the adjusted sub-band power values in each of the frequency ranges, and the power value ratio judging means 170 being operative to judge whether or not the power value ratio of each of the adjusted sub-band power values to the average value of the adjusted sub-band power values exceeds a predetermined threshold value in each of the frequency ranges.

Although there has been described in the above about the first embodiment of the microphone-speaker apparatus according to the present invention, this embodiment may be replaced by the microphone-speaker apparatus according to the second to sixth embodiments of the present invention in order to attain the object of the present invention. The second to sixth embodiments of the microphone-speaker apparatus will then be described hereinafter.

Referring then to FIGS. 2 to 6 of the drawings, there are shown block diagrams of the second to sixth embodiments of the microphone-speaker apparatus according to the present invention. The constitutional elements and the steps of the second to sixth embodiments of the microphone-speaker apparatus according to the present invention as shown in FIGS. 2 to 6 are entirely the same as those of the first embodiment of the microphone-speaker apparatus according to the present invention as shown in FIG. 1 except for the constitutional elements and the steps appearing in the following description. Therefore, only the constitutional elements and the steps of the second to sixth embodiments of the microphone-speaker apparatus different from those of the first embodiment of the microphone-speaker apparatus will be described in detail hereinafter. The constitutional elements and the steps of the second to sixth embodiments of the microphone-speaker apparatus entirely the same as those of the first embodiment of the microphone-speaker apparatus will not be described but bear the same reference numerals and legends as those of the first embodiment of the microphone-speaker apparatus in FIG. 1 to avoid tedious repetition.

The following description will be directed to the constitutional elements and the steps of the second embodiment of the microphone-speaker apparatus different from those of the microphone-speaker apparatus of the first embodiment.

Figure 2:
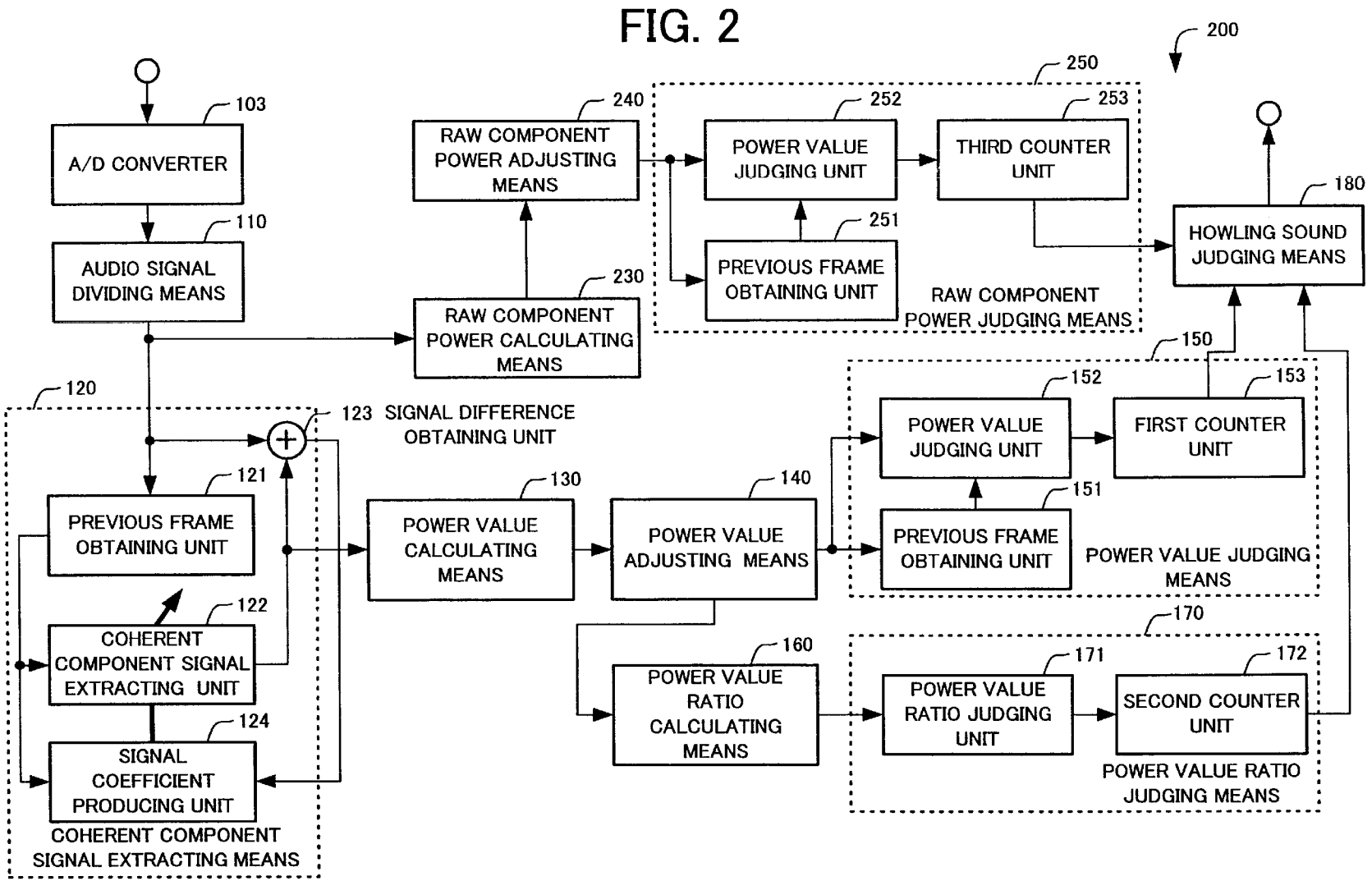
FIG. 2 is a block diagram of the microphone-speaker apparatus according to the second embodiment of the present invention.

The microphone-speaker apparatus 200 according to the second embodiment of the present invention is shown in FIG. 2 as comprising a microphone unit 101, an A/D converter 103, a speaker unit 102, audio signal dividing means 110, coherent component signal extracting means 120, power value calculating means 130, power value adjusting means 140, power value judging means 150, power value ratio calculating means 160, power value ratio judging means 170, howling sound judging means 180, and howling sound suppressing means 190, all of which are the same in construction as the microphone-speaker apparatus 100 shown in FIG. 1 and thus its construction will not be described hereinafter.

The microphone-speaker apparatus 200 according the second embodiment of the present invention further comprises raw component power calculating means 230 for calculating the power value of each of the raw component signals divided by the audio signal dividing means 110; raw component power adjusting means 240 for adjusting the power value of each of the raw component signals calculated by the raw component power calculating means 230 to produce an adjusted power value of each of the raw component signals; and raw component power judging means 250 for judging whether or not the power value of each of the raw component signals of the current frame exceeds the power value of each of the raw component signals of the preceding frame. The howling sound judging means 180 is operative to judge whether or not the howling sound is produced while the microphone unit 101 is receiving the audio sound outputted by the speaker unit 102 based on each of results judged by the power value judging means 150, the raw component power judging means 250, and the power value ratio judging means 170.

The raw component power judging means 250 includes a previous frame obtaining unit 251 for obtaining the raw component signals of the previous frame in response to the raw component signals of the current frame adjusted by the raw component power adjusting means 240, a power value judging unit 252 for judging whether or not the adjusted power value of the raw component signals of the current frame adjusted by the raw component power adjusting means 240 exceeds the adjusted power value of the raw component signals of the previous frame obtained by the previous frame obtaining unit 251, and a third counter unit 253 having a value and operative to allow the value to be incremented by a numeral "1" when the judgment is made by the power value judging unit 252 that the adjusted power value of the raw component signals of the current frame adjusted by the raw component power adjusting means 240 exceeds the adjusted power value of the raw component signals of the previous frame obtained by the previous frame obtaining unit 251. The howling sound judging means 180 is operative to judge whether or not the howling sound is produced while the microphone unit 101 is receiving the audio sound outputted by the speaker unit 102 during periodic intervals through steps of judging whether or not the value counted by the first counter unit 153 exceeds a predetermined second predetermined value, judging whether or not the value counted by the second counter unit 172 exceeds a predetermined third predetermined value, and judging whether or not the value counted by the third counter unit 253 exceeds a predetermined fourth predetermined value.

The following description will now be directed to the process of the second embodiment of the microphone-speaker apparatus 200 according to the present invention with no flowchart.

The power value of each of the raw component signals divided by the audio signal dividing means 110 is firstly calculated by the raw component power calculating means 230. The power value of each of the raw component signals calculated by the raw component power calculating means 230 is then adjusted by the raw component power adjusting means 240 to produce an adjusted power value of each of the raw component signals. The judgment is then made by the raw component power judging means 250 whether or not the power value of each of the raw component signals of the current frame exceeds the power value of each of the raw component signals of the preceding frame.

The third counter unit 253 is controlled by the power value judging unit 252 to allow the value to be incremented by a numeral "1" when the judgment is made by the power value judging unit 252 that the adjusted power value of the raw component signals of the current frame adjusted by the raw component power adjusting means 240 exceeds the adjusted power value of the raw component signals of the previous frame obtained by the previous frame obtaining unit 251. The third counter unit 253 is, on the other hand, controlled by the power value judging unit 252 to allow the value to be replaced by a numeral "0" when the judgment is made by the power value judging unit 252 that the adjusted power value of the raw component signals of the current frame adjusted by the raw component power adjusting means 240 does not exceed the adjusted power value of the raw component signals of the previous frame obtained by the previous frame obtaining unit 251.

The judgment is finally made by the howling sound judging means 180 on whether or not the howling sound is produced while the microphone unit 101 is receiving the audio sound outputted by the speaker unit 102 based on results judged by each of the power value judging means 150, the raw component power judging means 250, and the power value ratio judging means 170.

From the above detailed description, it will be understood that the microphone-speaker apparatus according to the first embodiment of the present invention can enhance the quality of the audio sound to be outputted by the speaker unit by judging whether or not the howling sound is produced while the microphone unit is receiving the audio sound outputted by the speaker unit without being affected by the amplitude of the audio sound received by the microphone unit.

While there has been described in the foregoing second embodiment about the fact that the raw component power judging means 250 includes a previous frame obtaining unit 251 for obtaining the raw component signals of the previous frame in response to the raw component signals of the current frame adjusted by the raw component power adjusting means 240, a power value judging unit 252 for judging whether or not the adjusted power value of the raw component signals of the current frame adjusted by the raw component power adjusting means 240 exceeds the adjusted power value of the raw component signals of the previous frame obtained by the previous frame obtaining unit 251, and a third counter unit 253 having a value and operative to allow the value to be incremented by a numeral "1" when the judgment is made by the power value judging unit 252 that the adjusted power value of the raw component signals of the current frame adjusted by the raw component power adjusting means 240 exceeds the adjusted power value of the raw component signals of the previous frame obtained by the previous frame obtaining unit 251. The howling sound judging means 180 is operative to judge whether or not the howling sound is produced while the microphone unit 101 is receiving the audio sound outputted by the speaker unit 102 during periodic intervals through steps of judging whether or not the value counted by the first counter unit 153 exceeds a predetermined second predetermined value, judging whether or not the value counted by the second counter unit 172 exceeds a predetermined third predetermined value, and judging whether or not the value counted by the third counter unit 253 exceeds a predetermined fourth predetermined value, the raw component power judging means 250 may include maximum power value obtaining unit 254 for obtaining a maximum power value from among the adjusted power values of the raw component signals adjusted by the raw component power adjusting means 240; a previous frame obtaining unit 251 for obtaining the maximum power value of the raw component signals of the previous frame in response to the maximum power value of the raw component signals of the current frame obtained by the maximum power value obtaining unit 254, a power value judging unit 252 for judging whether or not the maximum power value of the raw component signals of the current frame obtained by the maximum power value obtaining unit 254 exceeds the maximum power value of the raw component signals of the previous frame obtained by the previous frame obtaining unit 251, and a third counter unit 253 having a value and operative to allow the value to be incremented by a numeral "1" when the judgment is made by the power value judging unit 252 that the maximum power value of the raw component signals of the current frame obtained by the maximum power value obtaining unit 254 exceeds the maximum power value of the raw component signals of the previous frame obtained by the previous frame obtaining unit 251.

On the other hand, the raw component power judging means 250, may include minimum power value obtaining unit 255 for obtaining a minimum power value from among the adjusted power values of the raw component signals adjusted by the raw component power adjusting means 240; a previous frame obtaining unit 251 for obtaining the minimum power value of the raw component signals of the previous frame in response to the minimum power value of the raw component signals of the current frame obtained by the minimum power value obtaining unit 255, a power value judging unit 252 for judging whether or not the minimum power value of the raw component signals of the current frame obtained by the minimum power value obtaining unit 255 exceeds the minimum power value of the raw component signals of the previous frame obtained by the previous frame obtaining unit 251, and a third counter unit 253 having a value and operative to allow the value to be incremented by a numeral "1" when the judgment is made by the power value judging unit 252 that the minimum power value of the raw component signals of the current frame obtained by the minimum power value obtaining unit 255 exceeds the minimum power value of the raw component signals of the previous frame obtained by the previous frame obtaining unit 251.

The raw sound wave is constituted by a plurality of sub-band sound wave components each having a frequency range and a raw sub-band power value.

In the second embodiment, the raw component power calculating means 230 is operative to calculate the power value of each of the raw component signals divided by the audio signal dividing means 110, however, the raw component power calculating means 230, may be operative to calculate each of the raw sub-band power values from the raw component signals divided by the audio signal dividing means 110 in each of the frequency ranges, the raw component power adjusting means 240 being operative to respectively adjust the raw sub-band power values calculated by the raw component power calculating means 230 to produce an adjusted sub-band power values in each of the frequency ranges, and the raw component power judging means 250 being operative to judge whether or not the adjusted sub-band power values of the current frame exceeds the adjusted sub-band power value of the previous frame in each of the frequency ranges in each of the frequency ranges.

The following description will be directed to the constitutional elements and the steps of the third embodiment of the microphone-speaker apparatus different from those of the microphone-speaker apparatus of the first and second embodiments.

Figure 3:
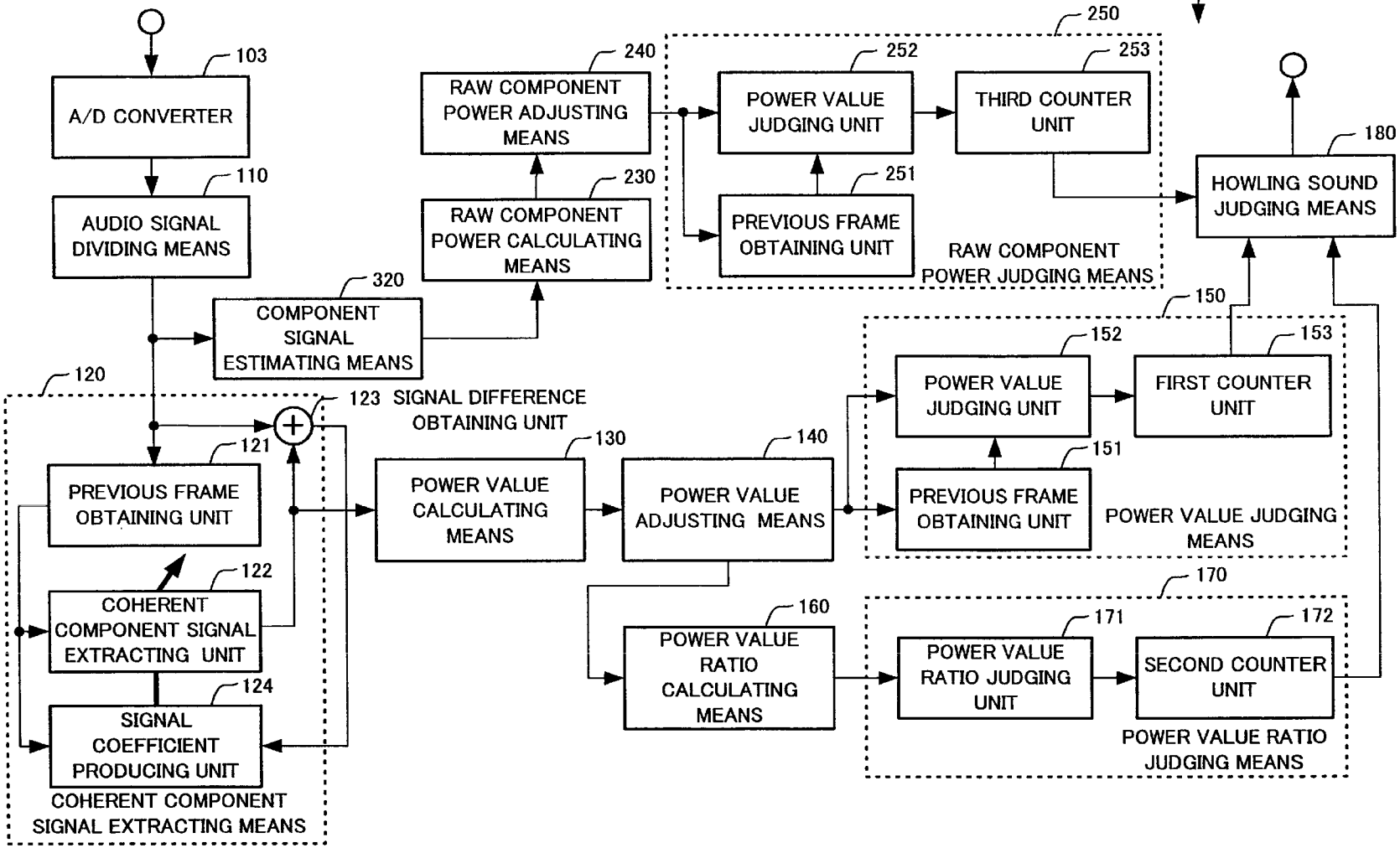
FIG. 3 is a block diagram of the microphone-speaker apparatus according to the third embodiment of the present invention.

The microphone-speaker apparatus 300 according the third embodiment of the present invention is shown in FIG. 3 as comprising a microphone unit 101, an A/D converter 103, a speaker unit 102, audio signal dividing means 110, coherent component signal extracting means 120, power value calculating means 130, power value adjusting means 140, power value judging means 150, power value ratio calculating means 160, power value ratio judging means 170, howling sound judging means 180, and howling sound suppressing means 190, all of which are the same in construction as the microphone-speaker apparatus 100 shown in FIG. 1 and thus its construction will not be described hereinafter.

The microphone-speaker apparatus 300 according the third embodiment of the present invention further comprises component signal estimating means 320 for estimating and producing an estimated component signals of the current frames in response to both the raw component signals of the sequential frames divided by the audio signal dividing means 110 and the signal coefficients produced by the signal coefficient producing unit 124; raw component power calculating means 230 for calculating the power value of each of the estimated component signals estimated by the component signal estimating means 320; raw component power adjusting means 240 for adjusting the power value of each of the estimated component signals calculated by the raw component power calculating means 230 to produce an adjusted power value of each of the estimated component signals; and raw component power judging means 250 for judging whether or not the power value of each of the estimated component signals of the current frame adjusted by the raw component power adjusting means 240 exceeds the power value of each of the estimated component signals of the preceding frame adjusted by the raw component power adjusting means 240. The howling sound judging means 180 is operative to judge whether or not the howling sound is produced while the microphone unit 101 is receiving the audio sound outputted by the speaker unit 102 during periodic intervals based on each of results judged by the power value judging means 150, results judged by the raw component power judging means 250, and results judged by the power value ratio judging means 170.

The raw component power judging means 250 includes a previous frame obtaining unit 251 for obtaining the estimated component signals of the previous frame in response to the estimated component signals of the current frame adjusted by the raw component power adjusting means 240, a power value judging unit 252 for judging whether or not the adjusted power value of the estimated component signals of the current frame adjusted by the raw component power adjusting means 240 exceeds the adjusted power value of the estimated component signals of the previous frame obtained by the previous frame obtaining unit 251, and a third counter unit 253 having a value and operative to allow the value to be incremented by a numeral "1" when the judgment is made by the power value judging unit 252 that the adjusted power value of the estimated component signals of the current frame adjusted by the raw component power adjusting means 240 exceeds the adjusted power value of the estimated component signals of the previous frame obtained by the previous frame obtaining unit 251; and the howling sound judging means 180 is operative to judge whether or not the howling sound is produced while the microphone unit 101 is receiving the audio sound outputted by the speaker unit 102 during periodic intervals through steps of judging whether or not the value counted by the first counter unit 153 exceeds a predetermined second predetermined value, judging whether or not the value counted by the second counter unit 172 exceeds a predetermined third predetermined value, and judging whether or not the value counted by the third counter unit 253 exceeds a predetermined fourth predetermined value.

The following description will now be directed to the process of the third embodiment of the microphone-speaker apparatus 300 according to the present invention with no flowchart.

The estimated component signals of the current frames are firstly estimated and produced by the component signal estimating means 320 in response to both the raw component signals of the sequential frames divided by the audio signal dividing means 110 and the signal coefficients produced by the signal coefficient producing unit 124. The power value of each of the estimated component signals estimated by the component signal estimating means 320 is then calculated by the raw component power calculating means 230. The power value of each of the estimated component signals calculated by the raw component power calculating means 230 is then adjusted by the raw component power adjusting means 240 to produce an adjusted power value of each of the estimated component signals. The judgment is then made by the raw component power judging means 250 on whether or not the power value of each of the estimated component signals of the current frame adjusted by the raw component power adjusting means 240 exceeds the power value of each of the estimated component signals of the preceding frame adjusted by the raw component power adjusting means 240. The judgment is then made by the howling sound judging means 180 on whether or not the howling sound is produced while the microphone unit 101 is receiving the audio sound outputted by the speaker unit 102 during periodic intervals based on each of results judged by the power value judging means 150, results judged by the raw component power judging means 250, and results judged by the power value ratio judging means 170.

From the above detailed description, it will be understood that the microphone-speaker apparatus according to the third embodiment of the present invention can enhance the quality of the audio sound to be outputted by the speaker unit by judging whether or not the howling sound is produced while the microphone unit is receiving the audio sound outputted by the speaker unit without being affected by the amplitude of the audio sound received by the microphone unit.

While there has been described in the foregoing third embodiment about the fact that the raw component power judging means 250 includes a previous frame obtaining unit 251 for obtaining the estimated component signals of the previous frame in response to the estimated component signals of the current frame adjusted by the raw component power adjusting means 240, a power value judging unit 252 for judging whether or not the adjusted power value of the estimated component signals of the current frame adjusted by the raw component power adjusting means 240 exceeds the adjusted power value of the estimated component signals of the previous frame obtained by the previous frame obtaining unit 251, and a third counter unit 253 having a value and operative to allow the value to be incremented by a numeral "1" when the judgment is made by the power value judging unit 252 that the adjusted power value of the estimated component signals of the current frame adjusted by the raw component power adjusting means 240 exceeds the adjusted power value of the estimated component signals of the previous frame obtained by the previous frame obtaining unit 251, the raw component power judging means 250 may include a maximum power value obtaining unit 254 for obtaining a maximum power value from among the adjusted power values of the estimated component signals adjusted by the power value adjusting means 140; a previous frame obtaining unit 251 for obtaining the maximum power value of the estimated component signals of the previous frame in response to the maximum power value of the estimated component signals of the current frame obtained by the maximum power value obtaining unit 254, a power value judging unit 252 for judging whether or not the maximum power value of the estimated component signals of the current frame obtained by the maximum power value obtaining unit 254 exceeds the maximum power value of the estimated component signals of the previous frame obtained by the previous frame obtaining unit 251, and a third counter unit 253 having a value and operative to allow the value to be incremented by a numeral "1" when the judgment is made by the power value judging unit 252 that the maximum power value of the estimated component signals of the current frame obtained by the maximum power value obtaining unit 254 exceeds the maximum power value of the estimated component signals of the previous frame obtained by the previous frame obtaining unit 251.

On the other hand, the raw component power judging means 250 may include a minimum power value obtaining unit 255 for obtaining a minimum power value from among the adjusted power values of the estimated component signals adjusted by the raw component power adjusting means 240; a previous frame obtaining unit 251 for obtaining the minimum power value of the estimated component signals of the previous frame in response to the minimum power value of the raw estimated component signals of the current frame obtained by the minimum power value obtaining unit 255, a power value judging unit 252 for judging whether or not the minimum power value of the estimated component signals of the current frame obtained by the minimum power value obtaining unit 255 exceeds the minimum power value of the estimated component signals of the previous frame obtained by the previous frame obtaining unit 251, and a third counter unit 253 having a value and operative to allow the value to be incremented by a numeral "1" when the judgment is made by the power value judging unit 252 that the minimum power value of the estimated component signals of the current frame obtained by the minimum power value obtaining unit 255 exceeds the minimum power value of the estimated component signals of the previous frame obtained by the previous frame obtaining unit 251.

The raw sound wave is constituted by a plurality of sub-band sound wave components each having a frequency range and a raw sub-band power value.

In the third embodiment, the raw component power calculating means 230 is operative to calculate the power value of each of the estimated component signals estimated by the component signal estimating means 320 in each of the frequency ranges, however, the raw component power calculating means 230 may be operative to calculate each of the raw sub-band power values from the estimated component signals estimated by the component signal estimating means 320 in each of the frequency ranges, the raw component power adjusting means 240 being operative to respectively adjust the sub-band power values calculated by the raw component power calculating means 230 to produce adjusted sub-band power values in each of the frequency ranges; and the raw component power judging means 250 being operative to judging whether or not the each of the sub-band power values of the current frame exceeds each of the sub-band power value of the previous frame in each of the frequency ranges.

Figure 4:
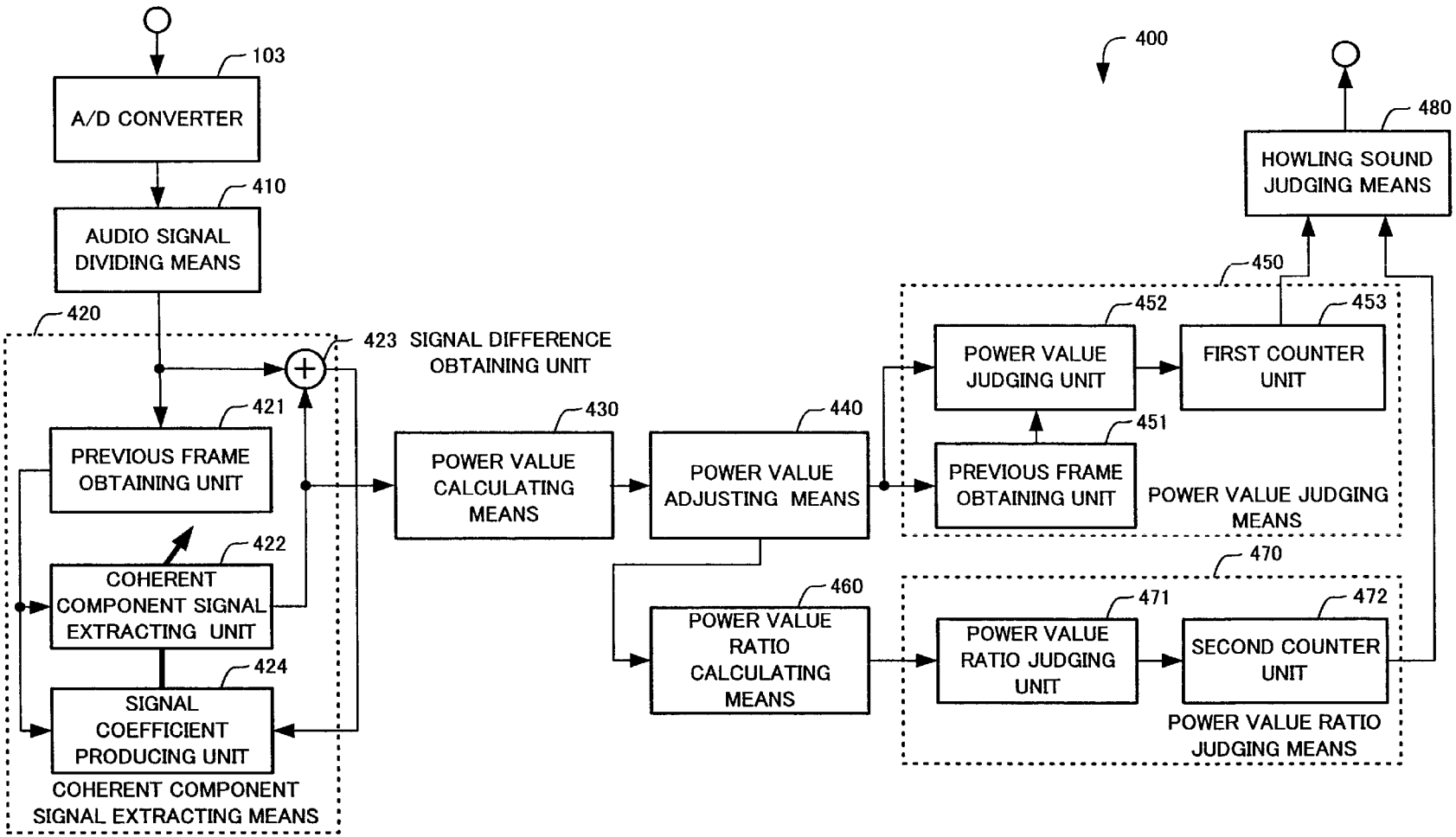
FIG. 4 is a block diagram of the microphone-speaker apparatus according to the fourth embodiment of the present invention.

The following description will be directed to fourth embodiments of the microphone-speaker apparatus according to the present invention with reference to FIG. 4.

The microphone-speaker apparatus 400 according the fourth embodiment of the present invention is shown in FIG. 4 as comprising: a microphone unit 101 for receiving an audio sound represented by a raw sound wave varied in response to a time axis to convert the audio sound to an audio signal, the raw sound wave including a coherent sound wave and an incoherent sound wave, the raw sound wave being constituted by a plurality of raw sub-band wave components each having a frequency range, and the coherent sound wave being constituted by a plurality of coherent wave components each having the audio frequency; a speaker unit 102 for outputting the audio sound to the microphone unit 101, the audio sound including a howling sound represented by the coherent sound wave, and the howling sound being produced while the microphone unit 101 is receiving the audio sound outputted by the speaker unit 102; audio signal dividing means 410 for dividing the audio signal indicative of the audio sound received by the microphone unit 101 into a plurality of raw sub-band component signals each indicative of the raw sub-band wave components, each of the raw sub-band component signals having a plurality of sequential frames divided along the time axis, and the sequential frames each having a current frame and a previous frame prior to the current frame; coherent component signal extracting means 420 for extracting a plurality of sub-band coherent component signals respectively indicative of the coherent wave components from the raw sub-band component signals divided by the audio signal dividing means 410 in each of the frequency ranges in each of sequential frames, and each of the sub-band coherent component signals in each of the sequential frames having a raw sub-band power value; power value calculating means 430 for calculating the raw sub-band power value of each of the sub-band coherent component signals extracted by the sub-band coherent component signal extracting means 420 in each of frequency ranges in each of sequential frames; power value adjusting means 440 for adjusting the raw sub-band power value of each of the sub-band coherent component signals calculated by the power value calculating means 430 to produce an adjusted sub-band power value of each of the sub-band coherent component signals in each of frequency ranges in each of sequential frames; power value judging means 450 for judging whether or not the adjusted sub-band power value of each of the sub-band coherent component signals of the current frame adjusted by the power value adjusting means 440 exceeds the adjusted sub-band power value of each of the sub-band coherent component signals of the previous frame adjusted by the power value adjusting means 440 in each of frequency ranges in each of sequential frames; power value ratio calculating means 460 for calculating a power value ratio of the adjusted sub-band power value of each of the sub-band coherent component signals to an average value of the adjusted sub-band power values of the sub-band coherent component signals adjusted by the power value adjusting means 440 in each of frequency ranges in each of sequential frames; power value ratio judging means 470 for judging whether or not the power value ratio of the adjusted sub-band power value of each of the sub-band coherent component signals to the average value of the adjusted sub-band power values of the sub-band coherent component signals calculated by the power value ratio calculating means 460 exceeds a predetermined threshold value in each of frequency ranges in each of sequential frames; howling sound judging means 480 for judging whether or not the howling sound is produced while the microphone unit 101 is receiving the audio sound outputted by the speaker unit 102 based on each of results judged by the power value judging means 450 and results judged by the power value ratio judging means 470 during periodic intervals; and howling sound suppressing means 190 for suppressing the howling sound based on results judged by the howling sound judging means 480.

Although there have been descried in the first to third embodiments about the fact that the audio signal dividing means 110 is operative to divide the audio signal received from the microphone unit 101 into a plurality of raw component signals based on the frequency components analyzing method such as for example Fast Fourier Transformation, the audio signal dividing means 410 forming part of the microphone-speaker apparatus 400 according to the fourth embodiment of the present invention is constituted by a plurality of band-pass filters. The band-bass filter may be constituted by any one of Finite Impulse Response filter, Infinite Impulse Response filter, and other digital signal processor which can divide the audio signal into the sub-band component signals each having a frequency range.

The coherent component signal extracting means 420 includes a previous frame obtaining unit 421 for obtaining the raw sub-band component signals of the previous frame in response to the raw sub-band component signals of the current frame divided by the audio signal dividing means 410, a coherent component signal extracting unit 422 for extracting the sub-band coherent component signals, a signal difference obtaining unit 423 for obtaining a signal difference between the raw sub-band component signals divided by the audio signal dividing means 410 and the sub-band coherent component signals extracted by the coherent component signal extracting unit 422, and a signal coefficient producing unit 424 for producing a plurality of signal coefficients in response to both the raw sub-band component signals of the previous frame obtained by the previous frame obtaining unit 421 and the signal difference between the raw sub-band component signals of the current frame and the sub-band coherent component signals of the current frame calculated by the signal difference obtaining unit 423. The coherent component signal extracting unit 422 is operative to extract the sub-band coherent component signals in response to both the raw sub-band component signals of the previous frame obtained by the previous frame obtaining unit 421 and the signal coefficients produced by the signal coefficient producing unit 424.

Similarly to the calculation of the adjusted power value of the component signals performed by the first power value adjusting means 140 as has been described with reference to the first embodiment of the present invention, the power value adjusting means 440 is operative to adjust the sub-band raw power value of each of the sub-band coherent component signals calculated by the power value calculating means 430 to obtain a sub-band adjusted power value "P(k)" of each of the sub-band coherent component signals through steps of adding a first product "FF×P_pre(k)" to a second product "(1.0−FF)×P(k−1)", the first product "FF×P_pre(k)" being indicative of a predetermined coefficient value "FF" multiplied by the raw power value "P_pre(k)" of each of the sub-band coherent component signals in the current frame "k" calculated by the power value calculating means 430, and the second product "(1.0−FF)×P(k−1)" being indicative of the adjusted power value "P(k−1)" of each of the sub-band coherent component signals in the preceding frame "k−1" adjusted by the power value adjusting means 440 multiplied by a value "1.0−FF" obtained by subtracting the predetermined coefficient value "FF" from a numerical value "1.0".

The power value judging means 450 includes a previous frame obtaining unit 451 for obtaining the sub-band coherent component signals of the previous frame in response to the sub-band coherent component signals of the current frame adjusted by the power value adjusting means 440, a power value judging unit 452 for judging whether or not the adjusted sub-band power value of the sub-band coherent component signals of the current frame adjusted by the power value adjusting means 440 exceeds the adjusted sub-band power value of the sub-band coherent component signals of the previous frame obtained by the previous frame obtaining unit 451, and a first counter unit 453 having a value and operative to allow the value to be incremented by a numeral "1" when the judgment is made by the power value judging unit 452 that the adjusted sub-band power value of the sub-band coherent component signals of the current frame adjusted by the power value adjusting means 440 exceeds the adjusted sub-band power value of the sub-band coherent component signals of the previous frame obtained by the previous frame obtaining unit 451.

The power value ratio judging means 470 includes a power value ratio judging unit 471 for judging whether or not the power value ratio of the adjusted sub-band power value of each of the sub-band coherent component signals to the average value of the adjusted sub-band power values of the sub-band coherent component signals calculated by the power value ratio calculating means 460 exceeds the predetermined first threshold value, and a second counter unit 472 having a value and operative to allow the value to be incremented by a numeral "1" when the judgment is made by the power value ratio judging unit 471 that the power value ratio of the adjusted sub-band power value of each of the sub-band coherent component signals to the mean value of the adjusted sub-band power values of the sub-band coherent component signals calculated by the power value ratio calculating means 460, and the howling sound judging means 480 is operative to judge whether or not the howling sound is produced while the microphone unit 101 is receiving the audio sound outputted by the speaker unit 102 during periodic intervals through steps of judging whether or not the value counted by the first counter unit 453 exceeds a predetermined second predetermined value, and judging whether or not the value counted by the second counter unit 472 exceeds a predetermined third predetermined value.

Figure 13:
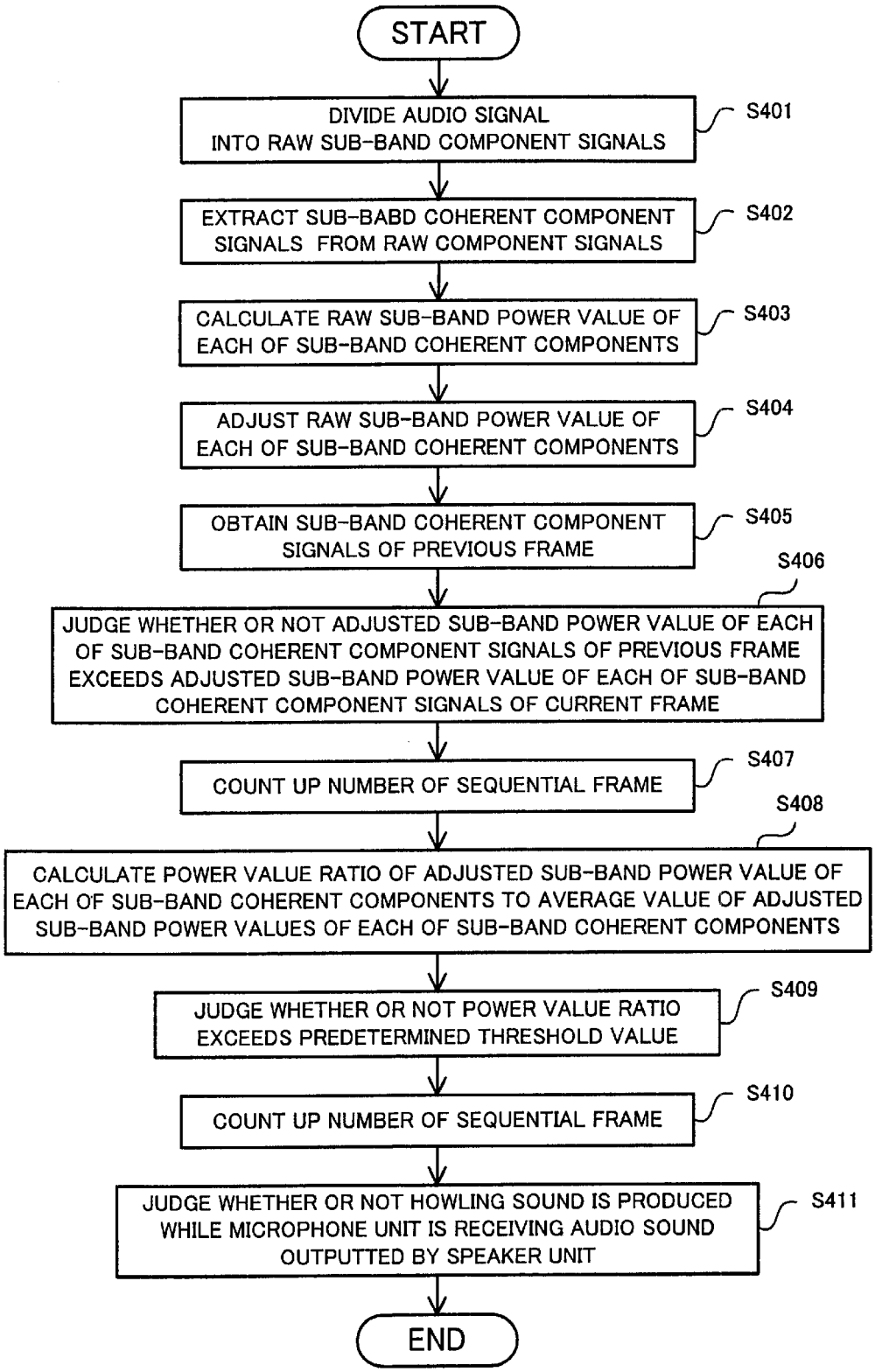
FIG. 13 is a flowchart of the microphone-speaker apparatus according to the fourth embodiment of the present invention.
Figure 14:
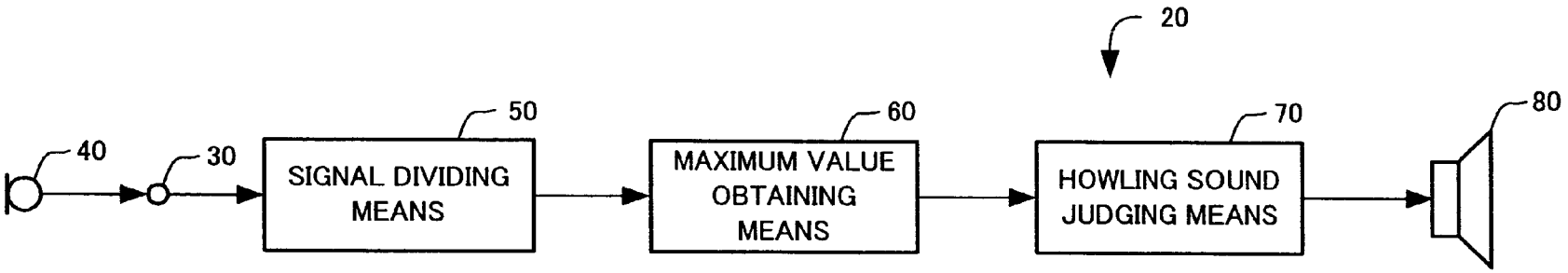
FIG. 14 is a block diagram of the conventional microphone-speaker apparatus.

The following description will be directed to the process of the fourth embodiment of the microphone-speaker apparatus 400 according to the present invention with reference to FIG. 13.

The audio sound is firstly received by the microphone unit 101 to convert the audio sound to an analog audio signal. The audio signal received from the microphone unit 101 through the A/D converter 103 is then divided by the audio signal dividing means 410 in the step S401.

The sub-band coherent component signals respectively indicative of the sub-band coherent wave components is then extracted by the coherent component signal extracting means 420 in response to the raw sub-band component signals divided by the audio signal dividing means 410 in each of the sequential frames in the step S402.

The raw sub-band power value of each of the sub-band coherent component signals extracted by the coherent component signal extracting means 420 is then calculated by the power value calculating means 430 in each of the sequential frames in the step S403.

The raw sub-band power value of each of the sub-band coherent component signals calculated by the power value calculating means 430 is then adjusted by the power value adjusting means 440 to produce an adjusted sub-band power value of each of the sub-band coherent component signals in each of the sequential frame in the step S404.

The sub-band coherent component signals of the previous frame is then obtained by the previous frame obtaining unit 451 forming part of the power value judging means 450 in response to the sub-band coherent component signals of the current frame adjusted by the power value adjusting means 440 in each of the sequential frames in the step S405.

The judgment is then made by the power value judging unit 452 forming part of the power value judging means 450 on whether or not the adjusted sub-band power value of the sub-band coherent component signals of the current frame adjusted by the power value adjusting means 440 exceeds the adjusted sub-band power value of the sub-band coherent component signals of the previous frame obtained by the previous frame obtaining unit 451 in each of the sequential frames in the step S406.

The first counter unit 453 is controlled by the power value judging unit 452 to allow the value to be incremented by a numeral "1" when the judgment is made that the adjusted sub-band power value of the sub-band coherent component signals of the current frame exceeds the adjusted sub-band power value of the sub-band coherent component signals of the previous frame in the step S407. The first counter unit 453 is, on the other hand, controlled by the power value judging unit 452 to allow the value to be replaced by a numeral "0" when the judgment is made that the adjusted sub-band power value of the sub-band coherent component signals of the current frame does not exceed the adjusted sub-band power value of the sub-band coherent component signals of the previous frame.

The power value ratio of the adjusted sub-band power value of each of the sub-band coherent component signals to an average value of the adjusted sub-band power values of the sub-band coherent component signals is then calculated by the power value ratio calculating means 460 in each of the sequential frames in the step S408.

The judgment is then made by the power value ratio judging unit 471 forming part of the power value ratio judging means 470 on whether or not the power value ratio of the adjusted sub-band power value of each of the sub-band coherent component signals to the average value of the adjusted sub-band power values of the sub-band coherent component signals calculated by the power value ratio calculating means 460 exceeds the predetermined first threshold value in each of the sequential frames in the step S409.

The number of the sequential frame in which the judgment is made that the power value ratio of the adjusted sub-band power value of each of the sub-band coherent component signals to the mean value of the adjusted sub-band power values of the sub-band coherent component signals is then counted by the second counter unit 472 forming part of the power value ratio judging means 470 in the step S410.

The judgment is then made by the howling sound judging means 480 on whether or not the howling sound is produced while the microphone unit 101 is receiving the audio sound outputted by the speaker unit 102 during periodic intervals through steps of judging whether or not the value counted by the first counter unit 453 exceeds a predetermined second predetermined value, and judging whether or not the value counted by the second counter unit 472 exceeds a predetermined third predetermined value during predetermined periodic intervals in the step S411.

The howling sound is finally suppressed by the howling sound suppressing means 190 based on results judged by the howling sound judging means 480 in the step S412.

From the above detailed description, it will be understood that the microphone-speaker apparatus according to the fourth embodiment of the present invention can enhance the quality of the audio sound to be outputted by the speaker unit by judging whether or not the howling sound is produced while the microphone unit is receiving the audio sound outputted by the speaker unit without being affected by the amplitude of the audio sound received by the microphone unit.

While there has been described in the foregoing fourth embodiment about the fact that the power value judging means 450 includes a previous frame obtaining unit 451 for obtaining the sub-band coherent component signals of the previous frame in response to the sub-band coherent component signals of the current frame adjusted by the power value adjusting means 440, a power value judging unit 452 for judging whether or not the adjusted sub-band power value of the sub-band coherent component signals of the current frame adjusted by the power value adjusting means 440 exceeds the adjusted sub-band power value of the sub-band coherent component signals of the previous frame obtained by the previous frame obtaining unit 451, and a first counter unit 453 having a value and operative to allow the value to be incremented by a numeral "1" when the judgment is made by the power value judging unit 452 that the adjusted sub-band power value of the sub-band coherent component signals of the current frame adjusted by the power value adjusting means 440 exceeds the adjusted sub-band power value of the sub-band coherent component signals of the previous frame obtained by the previous frame obtaining unit 451, the power value judging means 450 may include maximum power value obtaining unit for obtaining a maximum power value from among the adjusted power values of the sub-band coherent component signals adjusted by the power value adjusting means 440; a previous frame obtaining unit 451 for obtaining the maximum power value of the sub-band coherent component signals of the previous frame in response to the maximum power value of the sub-band coherent component signals of the current frame obtained by the maximum power value obtaining unit, a power value judging unit 452 for judging whether or not the maximum power value of the sub-band coherent component signals of the current frame obtained by the maximum power value obtaining unit exceeds the maximum power value of the sub-band coherent component signals of the previous frame obtained by the previous frame obtaining unit 451, and a third counter unit 453 having a value and operative to allow the value to be incremented by a numeral "1" when the judgment is made by the power value judging unit 452 that the maximum power value of the sub-band coherent component signals of the current frame obtained by the maximum power value obtaining unit exceeds the maximum power value of the sub-band coherent component signals of the previous frame obtained by the previous frame obtaining unit 451.

The power value judging means 450, on the other hand, may include minimum power value obtaining unit for obtaining a minimum power value from among the adjusted power values of the sub-band coherent component signals adjusted by the power value adjusting means 440; a previous frame obtaining unit 451 for obtaining the minimum power value of the sub-band coherent component signals of the previous frame in response to the minimum power value of the sub-band coherent component signals of the current frame obtained by the minimum power value obtaining unit, a power value judging unit 452 for judging whether or not the minimum power value of the sub-band coherent component signals of the current frame obtained by the minimum power value obtaining unit exceeds the minimum power value of the sub-band coherent component signals of the previous frame obtained by the previous frame obtaining unit 451, and a third counter unit 453 having a value and operative to allow the value to be incremented by a numeral "1" when the judgment is made by the power value judging unit 452 that the minimum power value of the sub-band coherent component signals of the current frame obtained by the minimum power value obtaining unit exceeds the minimum power value of the sub-band coherent component signals of the previous frame obtained by the previous frame obtaining unit 451.

The following description will be directed to the constitutional elements and the steps of the fifth embodiment of the microphone-speaker apparatus different from those of the microphone-speaker apparatus of the fourth embodiment.

Figure 5:
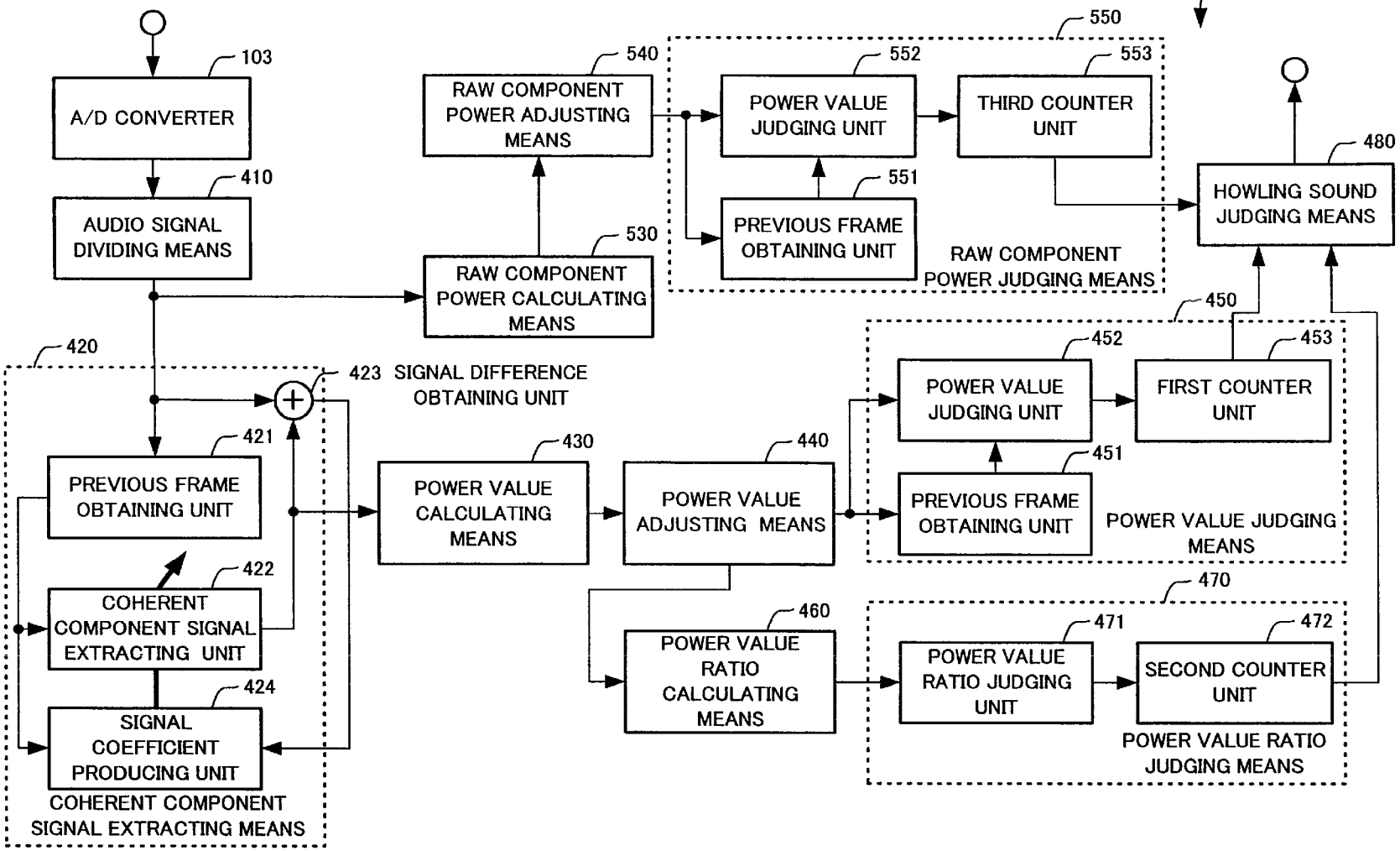
FIG. 5 is a block diagram of the microphone-speaker apparatus according to the fifth embodiment of the present invention.

The microphone-speaker apparatus 500 according the fifth embodiment of the present invention is shown in FIG. 5 as comprising a microphone unit 101, an A/D converter 103, a speaker unit 102, audio signal dividing means 410, coherent component signal extracting means 420, power value calculating means 430, power value adjusting means 440, power value judging means 450, power value ratio calculating means 460, power value ratio judging means 470, howling sound judging means 480, and howling sound suppressing means 190, all of which are the same in construction as the microphone-speaker apparatus 400 shown in FIG. 4 and thus its construction will not be described hereinafter.

The microphone-speaker apparatus 500 according to the fifth embodiment of the present invention further comprises raw component power calculating means 530 for calculating the power value of each of the raw sub-band component signals divided by the audio signal dividing means 410; raw component power adjusting means 540 for adjusting the power value of each of the raw sub-band component signals calculated by the raw component power calculating means 530 to produce an adjusted power value of each of the raw sub-band component signals; and raw component power judging means 550 for judging whether or not the power value of each of the raw sub-band component signals of the current frame exceeds the power value of each of the raw sub-band component signals of the preceding frame. The howling sound judging means 480 is operative to judge whether or not the howling sound is produced while the microphone unit 101 is receiving the audio sound outputted by the speaker unit 102 during periodic intervals based on each of results judged by the power value judging means 450, results judged by the raw component power judging means 550, and results judged by the power value ratio judging means 470.

The raw component power judging means 550 includes a previous frame obtaining unit 551 for obtaining the raw sub-band component signals of the previous frame in response to the raw sub-band component signals of the current frame adjusted by the raw component power adjusting means 540, a power value judging unit 552 for judging whether or not the adjusted power value of the raw sub-band component signals of the current frame adjusted by the raw component power adjusting means 540 exceeds the adjusted power value of the raw sub-band component signals of the previous frame obtained by the previous frame obtaining unit 551, and a third counter unit 553 having a value and operative to allow the value to be incremented by a numeral "1" when the judgment is made by the power value judging unit 552 that the adjusted power value of the raw sub-band component signals of the current frame adjusted by the raw power value adjusting means 540 exceeds the adjusted power value of the raw sub-band component signals of the previous frame obtained by the previous frame obtaining unit 551. The howling sound judging means 480 is operative to judge whether or not the howling sound is produced while the microphone unit 101 is receiving the audio sound outputted by the speaker unit 102 during periodic intervals through steps of judging whether or not the value counted by the first counter unit 453 exceeds a predetermined second predetermined value, judging whether or not the value counted by the second counter unit 472 exceeds a predetermined third predetermined value, and judging whether or not the value counted by the third counter unit 553 exceeds a predetermined fourth predetermined value.

The following description will now be directed to the process of the second embodiment of the microphone-speaker apparatus 500 according to the present invention with no flowchart.

The power value of each of the raw sub-band component signals divided by the audio signal dividing means 410 is firstly calculated by the raw component power calculating means 530. The power value of each of the raw sub-band component signals calculated by the raw component power calculating means 530 is then adjusted by the raw component power adjusting means 540 to produce an adjusted power value of each of the raw sub-band component signals. The raw sub-band component signals of the previous frame are respectively obtained by the previous frame obtaining unit 551 in response to the raw sub-band component signals of the current frame adjusted by the raw component power adjusting means 540. The judgment is then made by the power value judging unit 552 on whether or not the adjusted power value of the raw sub-band component signals of the current frame adjusted by the raw component power adjusting means 540 exceeds the adjusted power value of the raw sub-band component signals of the previous frame obtained by the previous frame obtaining unit 551.

The third counter unit 553 is controlled by the power value judging unit 552 to allow the value to be incremented by a numeral "1" when the judgment is made by the power value judging unit 552 that the adjusted power value of the raw sub-band component signals of the current frame adjusted by the raw power value adjusting means 540 exceeds the adjusted power value of the raw sub-band component signals of the previous frame obtained by the previous frame obtaining unit 551. The third counter unit 553 is, on the other hand, controlled by the power value judging unit 552 to allow the value to be replaced by a numeral "0" when the judgment is made by the power value judging unit 552 that the adjusted power value of the raw sub-band component signals of the current frame adjusted by the raw power value adjusting means 540 does not exceed the adjusted power value of the raw sub-band component signals of the previous frame obtained by the previous frame obtaining unit 551.

The judgment is then made by the raw component power judging means 550 on whether or not the power value of each of the raw sub-band component signals of the sequential frames is increased along the time axis based on the value counted by the third counter unit 553. The judgment is then made by the howling sound judging means 480 on whether or not the howling sound is produced while the microphone unit 101 is receiving the audio sound outputted by the speaker unit 102 during periodic intervals based on each of results judged by the power value judging means 450, results judged by the raw component power judging means 550, and results judged by the power value ratio judging means 470.

From the above detailed description, it will be understood that the microphone-speaker apparatus according to the fifth embodiment of the present invention can enhance the quality of the audio sound to be outputted by the speaker unit by judging whether or not the howling sound is produced while the microphone unit is receiving the audio sound outputted by the speaker unit without being affected by the amplitude of the audio sound received by the microphone unit.

While there has been described in the foregoing fifth embodiment about the fact that the raw component power judging means 550 includes a previous frame obtaining unit 551 for obtaining the raw sub-band component signals of the previous frame in response to the raw sub-band component signals of the current frame adjusted by the raw component power adjusting means 540, a power value judging unit 552 for judging whether or not the adjusted power value of the raw sub-band component signals of the current frame adjusted by the raw component power adjusting means 540 exceeds the adjusted power value of the raw sub-band component signals of the previous frame obtained by the previous frame obtaining unit 551, and a third counter unit 553 having a value and operative to allow the value to be incremented by a numeral "1" when the judgment is made by the power value judging unit 552 that the adjusted power value of the raw sub-band component signals of the current frame adjusted by the raw component power adjusting means 540 exceeds the adjusted power value of the raw sub-band component signals of the previous frame obtained by the previous frame obtaining unit 551, the raw component power judging means 550 may include maximum power value obtaining unit for obtaining a maximum power value from among the adjusted power values of the raw sub-band component signals adjusted by the raw component power adjusting means 540; a previous frame obtaining unit 551 for obtaining the maximum power value of the raw sub-band component signals of the previous frame in response to the maximum power value of the raw sub-band component signals of the current frame obtained by the maximum power value obtaining unit, a power value judging unit 552 for judging whether or not the maximum power value of the raw sub-band component signals of the current frame obtained by the maximum power value obtaining unit exceeds the maximum power value of the raw sub-band component signals of the previous frame obtained by the previous frame obtaining unit 551, and a third counter unit 553 having a value and operative to allow the value to be incremented by a numeral "1" when the judgment is made by the power value judging unit 552 that the maximum power value of the raw sub-band component signals of the current frame obtained by the maximum power value obtaining unit exceeds the maximum power value of the raw sub-band component signals of the previous frame obtained by the previous frame obtaining unit 551.

The raw component power judging means 550, on the other hand, may include minimum power value obtaining unit for obtaining a minimum power value from among the adjusted power values of the raw sub-band component signals adjusted by the raw component power adjusting means 540; a previous frame obtaining unit 551 for obtaining the minimum power value of the raw sub-band component signals of the previous frame in response to the minimum power value of the raw sub-band component signals of the current frame obtained by the minimum power value obtaining unit, a power value judging unit 552 for judging whether or not the minimum power value of the raw sub-band component signals of the current frame obtained by the minimum power value obtaining unit exceeds the minimum power value of the raw sub-band component signals of the previous frame obtained by the previous frame obtaining unit 551, and a third counter unit 553 having a value and operative to allow the value to be incremented by a numeral "1" when the judgment is made by the power value judging unit 552 that the minimum power value of the raw sub-band component signals of the current frame obtained by the minimum power value obtaining unit exceeds the minimum power value of the raw sub-band component signals of the previous frame obtained by the previous frame obtaining unit 551.

The following description will be directed to the constitutional elements and the steps of the sixth embodiment of the microphone-speaker apparatus different from those of the microphone-speaker apparatus of the fourth and fifth embodiments.

Figure 6:
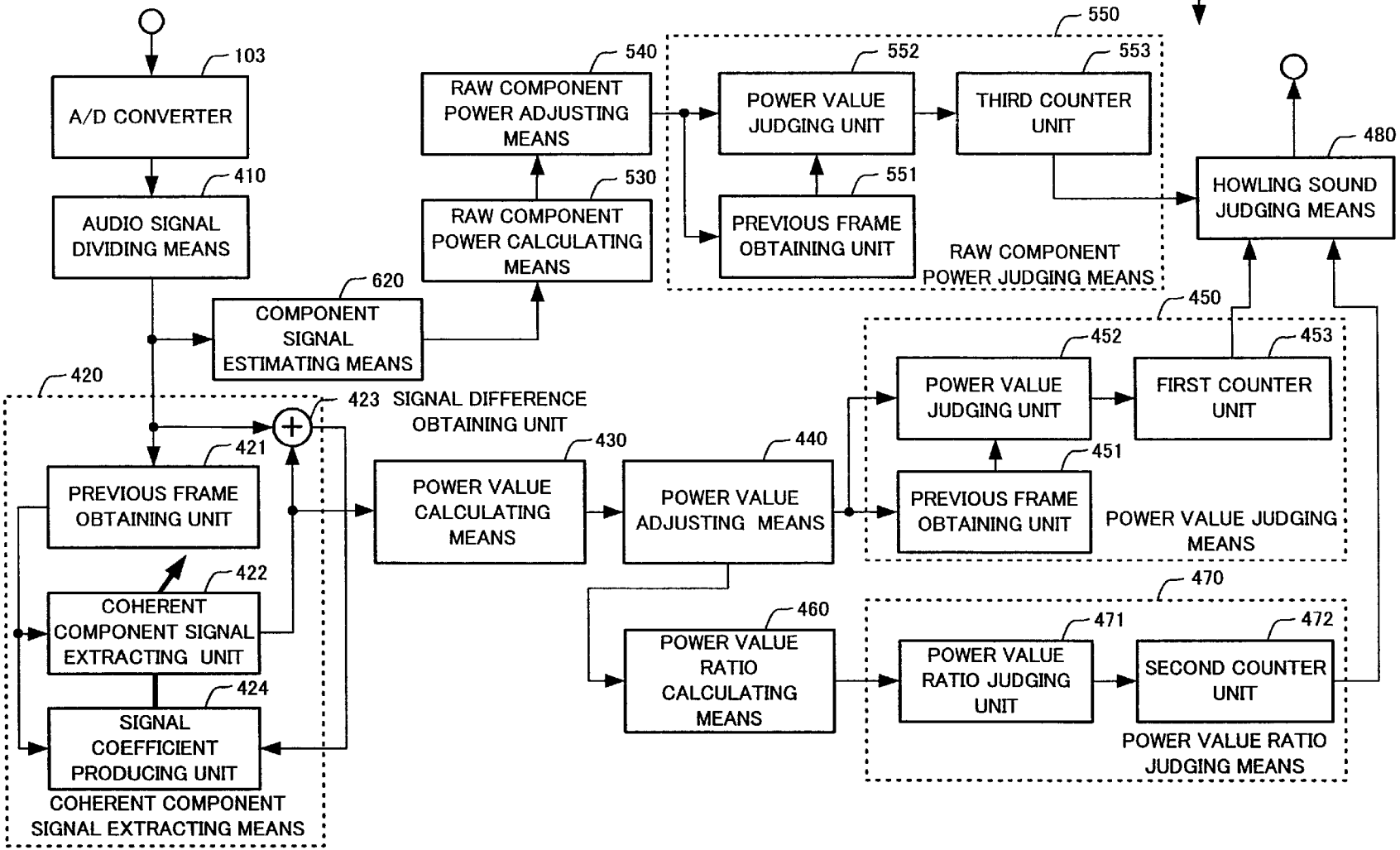
FIG. 6 is a block diagram of the microphone-speaker apparatus according to the sixth embodiment of the present invention.

The microphone-speaker apparatus 600 according the sixth embodiment of the present invention is shown in FIG. 6 as comprising a microphone unit 101, an A/D converter 103, a speaker unit 102, audio signal dividing means 410, coherent component signal extracting means 420, power value calculating means 430, power value adjusting means 440, power value judging means 450, power value ratio calculating means 460, power value ratio judging means 470, howling sound judging means 480, and howling sound suppressing means 190, all of which are the same in construction as the microphone-speaker apparatus 400 shown in FIG. 4 and thus its construction will not be described hereinafter.

The microphone-speaker apparatus 600 further comprises component signal estimating means 620 for estimating and producing an estimated sub-band component signals of the current frames in response to both the raw sub-band component signals of the sequential frames divided by the audio signal dividing means 410 and the signal coefficients produced by the signal coefficient producing unit 424; raw component power calculating means 530 for calculating the power value of each of the estimated sub-band component signals estimated by the component signal estimating means 620; raw component power adjusting means 540 for adjusting the power value of each of the estimated sub-band component signals calculated by the raw component power calculating means 530 to produce an adjusted power value of each of the estimated sub-band component signals; and raw component power judging means 550 for judging whether or not the power value of each of the estimated sub-band component signals of the current frame adjusted by the raw component power adjusting means 540 exceeds the power value of each of the estimated sub-band component signals of the preceding frame adjusted by the raw component power adjusting means 540. The howling sound judging means 480 is operative to judge whether or not the howling sound is produced while the microphone unit 101 is receiving the audio sound outputted by the speaker unit 102 during periodic intervals based on each of results judged by the power value judging means 450, results judged by the raw component power judging means 550, and results judged by the power value ratio judging means 470.

The raw component power judging means 550 includes a previous frame obtaining unit 551 for obtaining the estimated sub-band component signals of the previous frame in response to the estimated sub-band component signals of the current frame adjusted by the raw component power adjusting means 540, a power value judging unit 552 for judging whether or not the adjusted power value of the estimated sub-band component signals of the current frame adjusted by the raw component power adjusting means 540 exceeds the adjusted power value of the estimated sub-band component signals of the previous frame obtained by the previous frame obtaining unit 551, and a third counter unit 553 having a value and operative to allow the value to be incremented by a numeral "1" when the judgment is made by the power value judging unit 552 that the adjusted power value of the estimated sub-band component signals of the current frame adjusted by the raw component power adjusting means 540 exceeds the adjusted power value of the estimated sub-band component signals of the previous frame obtained by the previous frame obtaining unit 551. The howling sound judging means 480 is operative to judge whether or not the howling sound is produced while the microphone unit 101 is receiving the audio sound outputted by the speaker unit 102 during periodic intervals through steps of judging whether or not the value counted by the first counter unit 453 exceeds a predetermined second predetermined value, judging whether or not the value counted by the second counter unit 472 exceeds a predetermined third predetermined value, and judging whether or not the value counted by the third counter unit 553 exceeds a predetermined fourth predetermined value.

The following description will now be directed to the process of the sixth embodiment of the microphone-speaker apparatus 600 according to the present invention with no flowchart.

The estimated sub-band component signals of the current frames are firstly estimated and produced by the component signal estimating means 620 in response to both the raw sub-band component signals of the sequential frames divided by the audio signal dividing means 410 and the signal coefficients produced by the signal coefficient producing unit 424.

The power value of each of the estimated sub-band component signals estimated by the component signal estimating means 620 is then calculated by the raw component power calculating means 530.

The power value of each of the estimated sub-band component signals calculated by the raw component power calculating means 530 is then adjusted by the raw component power adjusting means 540 to produce an adjusted power value of each of the estimated sub-band component signals.

Then judgment is then made by the raw component power judging means 550 on whether or not the power value of each of the estimated sub-band component signals of the current frame adjusted by the raw component power adjusting means 540 exceeds the power value of each of the estimated sub-band component signals of the preceding frame adjusted by the raw component power adjusting means 540.

The judgment is finally made by the howling sound judging means 480 on whether or not the howling sound is produced while the microphone unit 101 is receiving the audio sound outputted by the speaker unit 102 during periodic intervals based on each of results judged by the power value judging means 450, results judged by the raw component power judging means 550, and results judged by the power value ratio judging means 470.

From the above detailed description, it will be understood that the microphone-speaker apparatus according to the sixth embodiment of the present invention can enhance the quality of the audio sound to be outputted by the speaker unit by judging whether or not the howling sound is produced while the microphone unit is receiving the audio sound outputted by the speaker unit without being affected by the amplitude of the audio sound received by the microphone unit.

While there has been described in the foregoing sixth embodiment about the fact that the raw component power judging means 550 includes a previous frame obtaining unit 551 for obtaining the estimated sub-band component signals of the previous frame in response to the estimated sub-band component signals of the current frame adjusted by the raw component power adjusting means 540, a power value judging unit 552 for judging whether or not the adjusted power value of the estimated sub-band component signals of the current frame adjusted by the raw component power adjusting means 540 exceeds the adjusted power value of the estimated sub-band component signals of the previous frame obtained by the previous frame obtaining unit 551, and a third counter unit 553 having a value and operative to allow the value to be incremented by a numeral "1" when the judgment is made by the power value judging unit 552 that the adjusted power value of the estimated sub-band component signals of the current frame adjusted by the raw component power adjusting means 540 exceeds the adjusted power value of the estimated sub-band component signals of the previous frame obtained by the previous frame obtaining unit 551, the raw component power judging means 550 may include maximum power value obtaining unit for obtaining a maximum power value from among the adjusted power values of the estimated sub-band component signals adjusted by the raw component power adjusting means 540; a previous frame obtaining unit 551 for obtaining the maximum power value of the estimated sub-band component signals of the previous frame in response to the maximum power value of the estimated sub-band component signals of the current frame obtained by the maximum power value obtaining unit, a power value judging unit 552 for judging whether or not the maximum power value of the estimated sub-band component signals of the current frame obtained by the maximum power value obtaining unit exceeds the maximum power value of the estimated sub-band component signals of the previous frame obtained by the previous frame obtaining unit 551, and a third counter unit 553 having a value and operative to allow the value to be incremented by a numeral "1" when the judgment is made by the power value judging unit 552 that the maximum power value of the estimated sub-band component signals of the current frame obtained by the maximum power value obtaining unit exceeds the maximum power value of the estimated sub-band component signals of the previous frame obtained by the previous frame obtaining unit 551.

The raw component power judging means 550, on the other hand, may include minimum power value obtaining unit for obtaining a minimum power value from among the adjusted power values of the estimated sub-band component signals adjusted by the raw component power adjusting means 540; a previous frame obtaining unit 551 for obtaining the minimum power value of the estimated sub-band component signals of the previous frame in response to the minimum power value of the estimated sub-band component signals of the current frame obtained by the minimum power value obtaining unit, a power value judging unit 552 for judging whether or not the minimum power value of the estimated sub-band component signals of the current frame obtained by the minimum power value obtaining unit exceeds the minimum power value of the estimated sub-band component signals of the previous frame obtained by the previous frame obtaining unit 551, and a third counter unit 553 having a value and operative to allow the value to be incremented by a numeral "1" when the judgment is made by the power value judging unit 552 that the minimum power value of the estimated sub-band component signals of the current frame obtained by the minimum power value obtaining unit exceeds the minimum power value of the estimated sub-band component signals of the previous frame obtained by the previous frame obtaining unit 551.

As will be see from the forgoing description, the microphone-speaker apparatus can enhance the quality of the audio sound to be outputted by the speaker unit by judging whether or not the howling sound is produced while the microphone unit is receiving the audio sound outputted by the speaker unit without being affected by the amplitude of the audio sound received by the microphone unit.

While the subject invention has been described with relation to the preferred embodiments, various modifications and adaptations thereof will now be apparent to those skilled in the art as far as such modifications and adaptations fall within the scope of the appended claims intended to be covered thereby.

What is claimed is:

1. A microphone-speaker apparatus, comprising: a microphone unit for receiving an audio sound represented by a raw sound wave varied in response to a time axis, said raw sound wave including a coherent sound wave, said raw sound wave being constituted by a plurality of raw wave components each having an audio frequency, and said coherent sound wave being constituted by a plurality of coherent wave components; a speaker unit for outputting said audio sound to said microphone unit, said audio sound including a howling sound represented by at least one coherent sound wave, and said howling sound being produced while said microphone unit is receiving said audio sound outputted by said speaker unit; audio signal dividing means for dividing an audio signal indicative of said audio sound received by said microphone unit into a plurality of raw component signals each indicative of said raw wave components, each of said raw component signals having a plurality of sequential frames divided along said time axis, and said sequential frames each having a current frame and a previous frame prior to said current frame; coherent component signal extracting means for extracting a plurality of coherent component signals respectively indicative of said coherent wave components from said raw component signals divided by said audio signal dividing means, each of said coherent component signals in each of said sequential frames having a raw power value; power value calculating means for calculating said raw power value of each of said coherent component signals extracted by said coherent component signal extracting means; power value adjusting means for adjusting said raw power value of each of said coherent component signals calculated by said power value calculating means to produce an adjusted power value of each of said coherent component signals; power value judging means for judging whether or not said adjusted power value of each of said coherent component signals is increased along said time axis; power value ratio calculating means for calculating a power value ratio of said adjusted power value of each of said coherent component signals to an average value of said adjusted power values of said coherent component signals; power value ratio judging means for judging whether or not said power value ratio of said adjusted power value of each of said coherent component signals to said average value of said adjusted power values of said coherent component signals exceeds a predetermined threshold value; howling sound judging means for judging whether or not said howling sound is produced while said microphone unit is receiving said audio sound outputted by said speaker unit during periodic intervals based on each of results judged by said power value judging means and results judged by said power value ratio judging means; and howling sound suppressing means for suppressing said howling sound based on results judged by said howling sound judging means.

2. A microphone-speaker apparatus as set forth in claim 1, in which said coherent component signal extracting means includes a previous frame obtaining unit for obtaining said raw component signals of said previous frame in response to said raw component signals of said current frame divided by said audio signal dividing means, a coherent component signal extracting unit for extracting said coherent component signals, a signal difference obtaining unit for obtaining a signal difference between said raw component signals divided by said audio signal dividing means and said coherent component signals extracted by said coherent component signal extracting unit, and a signal coefficient producing unit for producing a plurality of signal coefficients in response to both said raw component signals of said previous frame obtained by said previous frame obtaining unit and said signal difference between said raw component signals of said current frame and said coherent component signals of said current frame calculated by said signal difference obtaining unit; and said coherent component signal extracting unit is operative to extract said coherent component signals in response to both said raw component signals of said previous frame obtained by said previous frame obtaining unit and said signal coefficients produced by said signal coefficient producing unit.

3. A microphone-speaker apparatus as set forth in claim 2, in which said power value adjusting means is operative to adjust said raw power value of each of said coherent component signals calculated by said power value calculating means to obtain an adjusted power value of each of said coherent component signals through steps of adding a first product A to a second product B, said first product A being indicative of a predetermined coefficient value multiplied by said raw power value of each of said coherent component signals in said current frame calculated by said power value calculating means, and said second product B being indicative of said adjusted power value of each of said coherent component signals in said preceding frame adjusted by said power value adjusting means multiplied by a value obtained by subtracting said predetermined coefficient value from a numerical value "1".

4. A microphone-speaker apparatus as set forth in claim 3, in which said power value judging means includes a previous frame obtaining unit for obtaining said coherent component signals of said previous frame in response to said coherent component signals of said current frame adjusted by said power value adjusting means, a power value judging unit for judging whether or not said adjusted power value of said coherent component signals of said current frame adjusted by said power value adjusting means exceeds said adjusted power value of said coherent component signals of said previous frame obtained by said previous frame obtaining unit, and a first counter unit for counting a number of said sequential frame in which said judgment is made by said power value judging unit that said adjusted power value of said coherent component signals of said current frame adjusted by said power value adjusting means exceeds said adjusted power value of said coherent component signals of said previous frame obtained by said previous frame obtaining unit; said power value ratio judging means includes a power value ratio judging unit for judging whether or not said power value ratio of said adjusted power value of each of said coherent component signals to said average value of said adjusted power values of said coherent component signals calculated by said power value ratio calculating means exceeds said predetermined first threshold value, and a second counter unit for counting a number of said sequential frame in which said judgment is made by said power value ratio judging unit that said power value ratio of said adjusted power value of each of said coherent component signals to said average value of said adjusted power values of said coherent component signals calculated by said power value ratio calculating means, and said howling sound judging means is operative to judge whether or not said howling sound is produced while said microphone unit is receiving said audio sound outputted by said speaker unit during periodic intervals through steps of judging whether or not said number of said sequential frame counted by said first counter unit exceeds a predetermined second predetermined value, and judging whether or not said number of said sequential frame counted by said second counter unit exceeds a predetermined third predetermined value.

5. A microphone-speaker apparatus as set forth in claim 4, which further comprises raw component power calculating means for calculating said power value of each of said raw component signals divided by said audio signal dividing means; raw component power adjusting means for adjusting said power value of each of said raw component signals calculated by said raw component power calculating means to produce an adjusted power value of each of said raw component signals; and raw component power judging means for judging whether or not said power value of each of said raw component signals of said current frame exceeds said power value of each of said raw component signals of said preceding frame, and in which said howling sound judging means is operative to judge whether or not said howling sound is produced while said microphone unit is receiving said audio sound outputted by said speaker unit during periodic intervals based on each of results judged by said power value judging means, results judged by said raw component power judging means, and results judged by said power value ratio judging means.

6. A microphone-speaker apparatus as set forth in claim 5, in which said raw component power judging means includes a previous frame obtaining unit for obtaining said raw component signals of said previous frame in response to said raw component signals of said current frame adjusted by said raw component power adjusting means, a power value judging unit for judging whether or not said adjusted power value of said raw component signals of said current frame adjusted by said raw component power adjusting means exceeds said adjusted power value of said raw component signals of said previous frame obtained by said previous frame obtaining unit, and a third counter unit for counting a number of said sequential frame in which said judgment is made by said power value judging unit that said adjusted power value of said raw component signals of said current frame adjusted by said power value adjusting means exceeds said adjusted power value of said raw component signals of said previous frame obtained by said previous frame obtaining unit; and said howling sound judging means is operative to judge whether or not said howling sound is produced while said microphone unit is receiving said audio sound outputted by said speaker unit during periodic intervals through steps of judging whether or not said number of said sequential frame counted by said first counter unit exceeds a predetermined second predetermined value, judging whether or not said number of said sequential frame counted by said second counter unit exceeds a predetermined third predetermined value, and judging whether or not said number of said sequential frame counted by said third counter unit exceeds a predetermined fourth predetermined value.

7. A microphone-speaker apparatus as set forth in claim 4, which further comprises component signal estimating means for estimating and producing an estimated component signals of said current frames in response to both said raw component signals of said sequential frames divided by said audio signal dividing means and said signal coefficients produced by said signal coefficient producing unit; raw component power calculating means for calculating said power value of each of said estimated component signals estimated by said component signal estimating means; raw component power adjusting means for adjusting said power value of each of said estimated component signals calculated by said raw component power calculating means to produce an adjusted power value of each of said estimated component signals; and raw component power judging means for judging whether or not said power value of each of said estimated component signals of said current frame adjusted by said raw component power adjusting means exceeds said power value of each of said estimated component signals of said preceding frame adjusted by said raw component power adjusting means, and in which said howling sound judging means is operative to judge whether or not said howling sound is produced while said microphone unit is receiving said audio sound outputted by said speaker unit during periodic intervals based on each of results judged by said power value judging means, results judged by said raw component power judging means, and results judged by said power value ratio judging means.

8. A microphone-speaker apparatus as set forth in claim 7, in which said raw component power judging means includes a previous frame obtaining unit for obtaining said estimated component signals of said previous frame in response to said estimated component signals of said current frame adjusted by said raw component power adjusting means, a power value judging unit for judging whether or not said adjusted power value of said estimated component signals of said current frame adjusted by said raw component power adjusting means exceeds said adjusted power value of said estimated component signals of said previous frame obtained by said previous frame obtaining unit, and a third counter unit for counting a number of said sequential frame in which said judgment is made by said power value judging unit that said adjusted power value of said estimated component signals of said current frame adjusted by said power value adjusting means exceeds said adjusted power value of said estimated component signals of said previous frame obtained by said previous frame obtaining unit; and said howling sound judging means is operative to judge whether or not said howling sound is produced while said microphone unit is receiving said audio sound outputted by said speaker unit during periodic intervals through steps of judging whether or not said number of said sequential frame counted by said first counter unit exceeds a predetermined second predetermined value, judging whether or not said number of said sequential frame counted by said second counter unit exceeds a predetermined third predetermined value, and judging whether or not said number of said sequential frame counted by said third counter unit exceeds a predetermined fourth predetermined value.

9. A microphone-speaker apparatus as set forth in claim 1, in which said power value judging means includes maximum power value obtaining unit for obtaining a maximum power value from among said adjusted power values of said coherent component signals adjusted by said power value adjusting means; a previous frame obtaining unit for obtaining said maximum power value of said coherent component signals of said previous frame in response to said maximum power value of said coherent component signals of said current frame obtained by said maximum power value obtaining unit, a power value judging unit for judging whether or not said maximum power value of said coherent component signals of said current frame obtained by said maximum power value obtaining unit exceeds said maximum power value of said coherent component signals of said previous frame obtained by said previous frame obtaining unit, and a first counter unit for counting a number of said sequential frame in which said judgment is made by said power value judging unit that said maximum power value of said coherent component signals of said current frame obtained by said maximum power value obtaining unit exceeds said maximum power value of said coherent component signals of said previous frame obtained by said previous frame obtaining unit.

10. A microphone-speaker apparatus as set forth in claim 1, in which said power value judging means includes minimum power value obtaining unit for obtaining a minimum power value from among said adjusted power values of said coherent component signals adjusted by said power value adjusting means; a previous frame obtaining unit for obtaining said minimum power value of said coherent component signals of said previous frame in response to said minimum power value of said coherent component signals of said current frame obtained by said minimum power value obtaining unit, a power value judging unit for judging whether or not said minimum power value of said coherent component signals of said current frame obtained by said minimum power value obtaining unit exceeds said minimum power value of said coherent component signals of said previous frame obtained by said previous frame obtaining unit, and a first counter unit for counting a number of said sequential frame in which said judgment is made by said power value judging unit that said minimum power value of said coherent component signals of said current frame obtained by said minimum power value obtaining unit exceeds said minimum power value of said coherent component signals of said previous frame obtained by said previous frame obtaining unit.

11. A microphone-speaker apparatus as set forth in claim 5, in which said raw component power judging means includes maximum power value obtaining unit for obtaining a maximum power value from among said adjusted power values of said raw component signals adjusted by said raw component power adjusting means; a previous frame obtaining unit for obtaining said maximum power value of said raw component signals of said previous frame in response to said maximum power value of said raw component signals of said current frame obtained by said maximum power value obtaining unit, a power value judging unit for judging whether or not said maximum power value of said raw component signals of said current frame obtained by said maximum power value obtaining unit exceeds said maximum power value of said raw component signals of said previous frame obtained by said previous frame obtaining unit, and a third counter unit for counting a number of said sequential frame in which said judgment is made by said power value judging unit that said maximum power value of said raw component signals of said current frame obtained by said maximum power value obtaining unit exceeds said maximum power value of said raw component signals of said previous frame obtained by said previous frame obtaining unit.

12. A microphone-speaker apparatus as set forth in claim 5, in which said raw component power judging means includes minimum power value obtaining unit for obtaining a minimum power value from among said adjusted power values of said raw component signals adjusted by said raw component power adjusting means; a previous frame obtaining unit for obtaining said minimum power value of said raw component signals of said previous frame in response to said minimum power value of said raw component signals of said current frame obtained by said minimum power value obtaining unit, a power value judging unit for judging whether or not said minimum power value of said raw component signals of said current frame obtained by said minimum power value obtaining unit exceeds said minimum power value of said raw component signals of said previous frame obtained by said previous frame obtaining unit, and a third counter unit for counting a number of said sequential frame in which said judgment is made by said power value judging unit that said minimum power value of said raw component signals of said current frame obtained by said minimum power value obtaining unit exceeds said minimum power value of said raw component signals of said previous frame obtained by said previous frame obtaining unit.

13. A microphone-speaker apparatus as set forth in claim 7, in which said raw component power judging means includes maximum power value obtaining unit for obtaining a maximum power value from among said adjusted power values of said estimated component signals adjusted by said raw component power adjusting means; a previous frame obtaining unit for obtaining said maximum power value of said estimated component signals of said previous frame in response to said maximum power value of said estimated component signals of said current frame obtained by said maximum power value obtaining unit, a power value judging unit for judging whether or not said maximum power value of said estimated component signals of said current frame obtained by said maximum power value obtaining unit exceeds said maximum power value of said estimated component signals of said previous frame obtained by said previous frame obtaining unit, and a third counter unit for counting a number of said sequential frame in which said judgment is made by said power value judging unit that said maximum power value of said estimated component signals of said current frame obtained by said maximum power value obtaining unit exceeds said maximum power value of said estimated component signals of said previous frame obtained by said previous frame obtaining unit.

14. A microphone-speaker apparatus as set forth in claim 7, in which said raw component power judging means includes minimum power value obtaining unit for obtaining a minimum power value from among said adjusted power values of said estimated component signals adjusted by said raw component power adjusting means; a previous frame obtaining unit for obtaining said minimum power value of said estimated component signals of said previous frame in response to said minimum power value of said raw estimated component signals of said current frame obtained by said minimum power value obtaining unit, a power value judging unit for judging whether or not said minimum power value of said estimated component signals of said current frame obtained by said minimum power value obtaining unit exceeds said minimum power value of said estimated component signals of said previous frame obtained by said previous frame obtaining unit, and a third counter unit for counting a number of said sequential frame in which said judgment is made by said power value judging unit that said minimum power value of said estimated component signals of said current frame obtained by said minimum power value obtaining unit exceeds said minimum power value of said estimated component signals of said previous frame obtained by said previous frame obtaining unit.

15. A microphone-speaker apparatus as set forth in claim 1, in which, said coherent sound wave is constituted by a plurality of sub-band coherent wave components each having a frequency range and a raw sub-band power value; said power value calculating means is operative to calculate each of said raw sub-band power values from said coherent component signals extracted by said coherent component signal extracting means; said power value adjusting means is operative to respectively adjust said raw sub-band power values calculated by said power value calculating means to produce an adjusted sub-band power values; said power value judging means is operative to judging whether or not said adjusted each of said adjusted sub-band power values of said current frame exceeds each of said adjusted sub-band power values of said previous frame in each of said frequency ranges; said power value ratio calculating means is operative to calculate a power value ratio of each of said adjusted sub-band power values to an average value of said adjusted sub-band power values; and said power value ratio judging means is operative to judge whether or not said power value ratio of each of said adjusted sub-band power values to said average value of said adjusted sub-band power values exceeds a predetermined threshold value.

16. A microphone-speaker apparatus as set forth in claim 5, in which, said raw sound wave is constituted by a plurality of sub-band sound wave components each having a frequency range and a raw sub-band power value; said raw component power calculating means is operative to calculate each of said raw sub-band power values from said raw component signals divided by said audio signal dividing means; said raw component power adjusting means is operative to respectively adjust said raw sub-band power values calculated by said raw component power calculating means to produce an adjusted sub-band power values; and said raw component power judging means is operative to judge whether or not said adjusted sub-band power values of said current frame exceeds said adjusted sub-band power value of said previous frame in each of said frequency ranges.

17. A microphone-speaker apparatus as set forth in claim 7, in which said raw sound wave is constituted by a plurality of sub-band sound wave components each having a frequency range and a raw sub-band power value; said raw component power calculating means is operative to calculate each of said raw sub-band power values from said estimated component signals estimated by said component signal estimating means; said raw component power adjusting means is operative to respectively adjust said sub-band power values calculated by said raw component power calculating means to produce adjusted sub-band power values; and said raw component power judging means is operative to judging whether or not said each of said sub-band power values of said current frame exceeds each of said sub-band power value of said previous frame in each of said frequency ranges.

18. A microphone-speaker apparatus, comprising: a microphone unit for receiving an audio sound represented by a raw sound wave varied in response to a time axis to convert said audio sound to an audio signal, said raw sound wave including a coherent sound wave and an incoherent sound wave, said raw sound wave being constituted by a plurality of raw sub-band wave components each having a frequency range, and said coherent sound wave being constituted by a plurality of coherent wave components each having said audio frequency; a speaker unit for outputting said audio sound to said microphone unit, said audio sound including a howling sound represented by said coherent sound wave, and said howling sound being produced while said microphone unit is receiving said audio sound outputted by said speaker unit; audio signal dividing means for dividing said audio signal converted by said microphone unit into a plurality of raw sub-band component signals each indicative of said raw sub-band wave components, each of said raw sub-band component signals having a plurality of sequential frames divided along said time axis, and said sequential frames each having a current frame and a previous frame prior to said current frame; coherent component signal extracting means for extracting a plurality of sub-band coherent component signals respectively indicative of said coherent wave components from said raw sub-band component signals divided by said audio signal dividing means, and each of said sub-band coherent component signals in each of said sequential frames having a raw sub-band power value; power value calculating means for calculating said raw sub-band power value of each of said sub-band coherent component signals extracted by said sub-band coherent component signal extracting means; power value adjusting means for adjusting said raw sub-band power value of each of said sub-band coherent component signals calculated by said power value calculating means to produce an adjusted sub-band power value of each of said sub-band coherent component signals; power value judging means for judging whether or not said adjusted sub-band power value of each of said sub-band coherent component signals of said current frame adjusted by said power value adjusting means exceeds said adjusted sub-band power value of each of said sub-band coherent component signals of said previous frame adjusted by said power value adjusting means; power value ratio calculating means for calculating a power value ratio of said adjusted sub-band power value of each of said sub-band coherent component signals to an average value of said adjusted sub-band power values of said sub-band coherent component signals adjusted by said power value adjusting means; power value ratio judging means for judging whether or not said power value ratio of said adjusted sub-band power value of each of said sub-band coherent component signals to said average value of said adjusted sub-band power values of said sub-band coherent component signals calculated by said power value ratio calculating means exceeds a predetermined threshold value; howling sound judging means for judging whether or not said howling sound is produced while said microphone unit is receiving said audio sound outputted by said speaker unit during periodic intervals based on results judged by said power value judging means and results judged by said power value ratio judging means; and howling sound suppressing means for suppressing said howling sound based on results judged by said howling sound judging means.

19. A microphone-speaker apparatus as set forth in claim 18, in which said coherent component signal extracting means includes a previous frame obtaining unit for obtaining said raw sub-band component signals of said previous frame in response to said raw sub-band component signals of said current frame divided by said audio signal dividing means, a coherent component signal extracting unit for extracting said sub-band coherent component signals, a signal difference obtaining unit for obtaining a signal difference between said raw sub-band component signals divided by said audio signal dividing means and said sub-band coherent component signals extracted by said coherent component signal extracting unit, and a signal coefficient producing unit for producing a plurality of signal coefficients in response to both said raw sub-band component signals of said previous frame obtained by said previous frame obtaining unit and said signal difference between said raw sub-band component signals of said current frame and said sub-band coherent component signals of said current frame calculated by said signal difference obtaining unit; and said coherent component signal extracting unit is operative to extract said sub-band coherent component signals in response to both said raw sub-band component signals of said previous frame obtained by said previous frame obtaining unit and said signal coefficients produced by said signal coefficient producing unit.

20. A microphone-speaker apparatus as set forth in claim 19, in which said power value adjusting means is operative to adjust said sub-band raw power value of each of said sub-band coherent component signals calculated by said power value calculating means to obtain a sub-band adjusted power value of each of said sub-band coherent component signals through steps of adding a first product A to a second product B, said first product A being indicative of a predetermined coefficient value multiplied by said raw power value of each of said sub-band coherent component signals in said current frame calculated by said power value calculating means, and said second product B being indicative of said adjusted power value of each of said sub-band coherent component signals in said preceding frame adjusted by said power value adjusting means multiplied by a value obtained by subtracting said predetermined coefficient value from a numerical value "1".

21. A microphone-speaker apparatus as set forth in claim 20, in which said power value judging means includes a previous frame obtaining unit for obtaining said sub-band coherent component signals of said previous frame in response to said sub-band coherent component signals of said current frame adjusted by said power value adjusting means, a power value judging unit for judging whether or not said adjusted sub-band power value of said sub-band coherent component signals of said current frame adjusted by said power value adjusting means exceeds said adjusted sub-band power value of said sub-band coherent component signals of said previous frame obtained by said previous frame obtaining unit, and a first counter unit for counting a number of said sequential frame in which said judgment is made by said power value judging unit that said adjusted sub-band power value of said sub-band coherent component signals of said current frame adjusted by said power value adjusting means exceeds said adjusted sub-band power value of said sub-band coherent component signals of said previous frame obtained by said previous frame obtaining unit; said power value ratio judging means includes a power value ratio judging unit for judging whether or not said power value ratio of said adjusted sub-band power value of each of said sub-band coherent component signals to said average value of said adjusted sub-band power values of said sub-band coherent component signals calculated by said power value ratio calculating means exceeds said predetermined first threshold value, and a second counter unit for counting a number of said sequential frame in which said judgment is made by said power value ratio judging unit that said power value ratio of said adjusted sub-band power value of each of said sub-band coherent component signals to said average value of said adjusted sub-band power values of said sub-band coherent component signals calculated by said power value ratio calculating means, and said howling sound judging means is operative to judge whether or not said howling sound is produced while said microphone unit is receiving said audio sound outputted by said speaker unit during periodic intervals through steps of judging whether or not said number of said sequential frame counted by said first counter unit exceeds a predetermined second predetermined value, and judging whether or not said number of said sequential frame counted by said second counter unit exceeds a predetermined third predetermined value.

22. A microphone-speaker apparatus as set forth in claim 21, which further comprises raw component power calculating means for calculating said power value of each of said raw sub-band component signals divided by said audio signal dividing means; raw component power adjusting means for adjusting said power value of each of said raw sub-band component signals calculated by said raw component power calculating means to produce an adjusted power value of each of said raw sub-band component signals; and raw component power judging means for judging whether or not said power value of each of said raw sub-band component signals of said current frame exceeds said power value of each of said raw sub-band component signals of said preceding frame, and in which said howling sound judging means is operative to judge whether or not said howling sound is produced while said microphone unit is receiving said audio sound outputted by said speaker unit during periodic intervals based on each of results judged by said power value judging means, results judged by said raw component power judging means, and results judged by said power value ratio judging means.

23. A microphone-speaker apparatus as set forth in claim 22, in which said raw component power judging means includes a previous frame obtaining unit for obtaining said raw sub-band component signals of said previous frame in response to said raw sub-band component signals of said current frame adjusted by said raw component power adjusting means, a power value judging unit for judging whether or not said adjusted power value of said raw sub-band component signals of said current frame adjusted by said raw component power adjusting means exceeds said adjusted power value of said raw sub-band component signals of said previous frame obtained by said previous frame obtaining unit, and a third counter unit for counting a number of said sequential frame in which said judgment is made by said power value judging unit that said adjusted power value of said raw sub-band component signals of said current frame adjusted by said power value adjusting means exceeds said adjusted power value of said raw sub-band component signals of said previous frame obtained by said previous frame obtaining unit; and said howling sound judging means is operative to judge whether or not said howling sound is produced while said microphone unit is receiving said audio sound outputted by said speaker unit during periodic intervals through steps of judging whether or not said number of said sequential frame counted by said first counter unit exceeds a predetermined second predetermined value, judging whether or not said number of said sequential frame counted by said second counter unit exceeds a predetermined third predetermined value, and judging whether or not said number of said sequential frame counted by said third counter unit exceeds a predetermined fourth predetermined value.

24. A microphone-speaker apparatus as set forth in claim 21, which further comprises component signal estimating means for estimating and producing an estimated sub-band component signals of said current frames in response to both said raw sub-band component signals of said sequential frames divided by said audio signal dividing means and said signal coefficients produced by said signal coefficient producing unit; raw component power calculating means for calculating said power value of each of said estimated sub-band component signals estimated by said component signal estimating means; raw component power adjusting means for adjusting said power value of each of said estimated sub-band component signals calculated by said raw component power calculating means to produce an adjusted power value of each of said estimated sub-band component signals; and raw component power judging means for judging whether or not said power value of each of said estimated sub-band component signals of said current frame adjusted by said raw component power adjusting means exceeds said power value of each of said estimated sub-band component signals of said preceding frame adjusted by said raw component power adjusting means, and in which said howling sound judging means is operative to judge whether or not said howling sound is produced while said microphone unit is receiving said audio sound outputted by said speaker unit during periodic intervals based on each of results judged by said power value judging means, results judged by said raw component power judging means, and results judged by said power value ratio judging means.

25. A microphone-speaker apparatus as set forth in claim 24, in which said raw component power judging means includes a previous frame obtaining unit for obtaining said estimated sub-band component signals of said previous frame in response to said estimated sub-band component signals of said current frame adjusted by said raw component power adjusting means, a power value judging unit for judging whether or not said adjusted power value of said estimated sub-band component signals of said current frame adjusted by said raw component power adjusting means exceeds said adjusted power value of said estimated sub-band component signals of said previous frame obtained by said previous frame obtaining unit, and a third counter unit for counting a number of said sequential frame in which said judgment is made by said power value judging unit that said adjusted power value of said estimated sub-band component signals of said current frame adjusted by said raw component power adjusting means exceeds said adjusted power value of said estimated sub-band component signals of said previous frame obtained by said previous frame obtaining unit; and said howling sound judging means is operative to judge whether or not said howling sound is produced while said microphone unit is receiving said audio sound outputted by said speaker unit during periodic intervals through steps of judging whether or not said number of said sequential frame counted by said first counter unit exceeds a predetermined second predetermined value, judging whether or not said number of said sequential frame counted by said second counter unit exceeds a predetermined third predetermined value, and judging whether or not said number of said sequential frame counted by said third counter unit exceeds a predetermined fourth predetermined value.

26. A microphone-speaker apparatus as set forth in claim 18, in which said power value judging means includes maximum power value obtaining unit for obtaining a maximum power value from among said adjusted power values of said sub-band coherent component signals adjusted by said power value adjusting means; a previous frame obtaining unit for obtaining said maximum power value of said sub-band coherent component signals of said previous frame in response to said maximum power value of said sub-band coherent component signals of said current frame obtained by said maximum power value obtaining unit, a power value judging unit for judging whether or not said maximum power value of said sub-band coherent component signals of said current frame obtained by said maximum power value obtaining unit exceeds said maximum power value of said sub-band coherent component signals of said previous frame obtained by said previous frame obtaining unit, and a first counter unit for counting a number of said sequential frame in which said judgment is made by said power value judging unit that said maximum power value of said sub-band coherent component signals of said current frame obtained by said maximum power value obtaining unit exceeds said maximum power value of said sub-band coherent component signals of said previous frame obtained by said previous frame obtaining unit.

27. A microphone-speaker apparatus as set forth in claim 18, in which said power value judging means includes minimum power value obtaining unit for obtaining a minimum power value from among said adjusted power values of said sub-band coherent component signals adjusted by said power value adjusting means; a previous frame obtaining unit for obtaining said minimum power value of said sub-band coherent component signals of said previous frame in response to said minimum power value of said sub-band coherent component signals of said current frame obtained by said minimum power value obtaining unit, a power value judging unit for judging whether or not said minimum power value of said sub-band coherent component signals of said current frame obtained by said minimum power value obtaining unit exceeds said minimum power value of said sub-band coherent component signals of said previous frame obtained by said previous frame obtaining unit, and a first counter unit for counting a number of said sequential frame in which said judgment is made by said power value judging unit that said minimum power value of said sub-band coherent component signals of said current frame obtained by said minimum power value obtaining unit exceeds said minimum power value of said sub-band coherent component signals of said previous frame obtained by said previous frame obtaining unit.

28. A microphone-speaker apparatus as set forth in claim 22, in which said raw component power judging means includes maximum power value obtaining unit for obtaining a maximum power value from among said adjusted power values of said raw sub-band component signals adjusted by said raw component power adjusting means; a previous frame obtaining unit for obtaining said maximum power value of said raw sub-band component signals of said previous frame in response to said maximum power value of said raw sub-band component signals of said current frame obtained by said maximum power value obtaining unit, a power value judging unit for judging whether or not said maximum power value of said raw sub-band component signals of said current frame obtained by said maximum power value obtaining unit exceeds said maximum power value of said raw sub-band component signals of said previous frame obtained by said previous frame obtaining unit, and a third counter unit for counting a number of said sequential frame in which said judgment is made by said power value judging unit that said maximum power value of said raw sub-band component signals of said current frame obtained by said maximum power value obtaining unit exceeds said maximum power value of said raw sub-band component signals of said previous frame obtained by said previous frame obtaining unit.

29. A microphone-speaker apparatus as set forth in claim 22, in which said raw component power judging means includes minimum power value obtaining unit for obtaining a minimum power value from among said adjusted power values of said raw sub-band component signals adjusted by said raw component power adjusting means; a previous frame obtaining unit for obtaining said minimum power value of said raw sub-band component signals of said previous frame in response to said minimum power value of said raw sub-band component signals of said current frame obtained by said minimum power value obtaining unit, a power value judging unit for judging whether or not said minimum power value of said raw sub-band component signals of said current frame obtained by said minimum power value obtaining unit exceeds said minimum power value of said raw sub-band component signals of said previous frame obtained by said previous frame obtaining unit, and a third counter unit for counting a number of said sequential frame in which said judgment is made by said power value judging unit that said minimum power value of said raw sub-band component signals of said current frame obtained by said minimum power value obtaining unit exceeds said minimum power value of said raw sub-band component signals of said previous frame obtained by said previous frame obtaining unit.

30. A microphone-speaker apparatus as set forth in claim 24, in which said raw component power judging means includes maximum power value obtaining unit for obtaining a maximum power value from among said adjusted power values of said estimated sub-band component signals adjusted by said raw component power adjusting means; a previous frame obtaining unit for obtaining said maximum power value of said estimated sub-band component signals of said previous frame in response to said maximum power value of said estimated sub-band component signals of said current frame obtained by said maximum power value obtaining unit, a power value judging unit for judging whether or not said maximum power value of said estimated sub-band component signals of said current frame obtained by said maximum power value obtaining unit exceeds said maximum power value of said estimated sub-band component signals of said previous frame obtained by said previous frame obtaining unit, and a third counter unit for counting a number of said sequential frame in which said judgment is made by said power value judging unit that said maximum power value of said estimated sub-band component signals of said current frame obtained by said maximum power value obtaining unit exceeds said maximum power value of said estimated sub-band component signals of said previous frame obtained by said previous frame obtaining unit.

31. A microphone-speaker apparatus as set forth in claim 24, in which said raw component power judging means includes minimum power value obtaining unit for obtaining a minimum power value from among said adjusted power values of said estimated sub-band component signals adjusted by said raw component power adjusting means; a previous frame obtaining unit for obtaining said minimum power value of said estimated sub-band component signals of said previous frame in response to said minimum power value of said estimated sub-band component signals of said current frame obtained by said minimum power value obtaining unit, a power value judging unit for judging whether or not said minimum power value of said estimated sub-band component signals of said current frame obtained by said minimum power value obtaining unit exceeds said minimum power value of said estimated sub-band component signals of said previous frame obtained by said previous frame obtaining unit, and a third counter unit for counting a number of said sequential frame in which said judgment is made by said power value judging unit that said minimum power value of said estimated sub-band component signals of said current frame obtained by said minimum power value obtaining unit exceeds said minimum power value of said estimated sub-band component signals of said previous frame obtained by said previous frame obtaining unit.

* * * * *